US011618044B2

(12) United States Patent
Chen

(10) Patent No.: US 11,618,044 B2
(45) Date of Patent: Apr. 4, 2023

(54) SPRAY DEVICE AND SPRAY SYSTEM

(71) Applicant: Qijun Lv, Yuyao (CN)

(72) Inventor: Jianmeng Chen, Yuyao (CN)

(73) Assignee: Qijun Lv, Yuyao (CN)

( * ) Notice: Subject to any disclaimer, the term of this patent is extended or adjusted under 35 U.S.C. 154(b) by 37 days.

(21) Appl. No.: 17/183,686

(22) Filed: Feb. 24, 2021

(65) Prior Publication Data

US 2022/0193705 A1 Jun. 23, 2022

(30) Foreign Application Priority Data

Dec. 18, 2020 (CN) ..... 202023067597.1

(51) Int. Cl.
*B05B 7/24* (2006.01)
*B05B 7/04* (2006.01)

(52) U.S. Cl.
CPC ..... *B05B 7/2443* (2013.01); *B05B 7/0408* (2013.01)

(58) Field of Classification Search
CPC ..... B05B 7/2443; B05B 7/0408
USPC ..... 239/310
See application file for complete search history.

(56) References Cited

U.S. PATENT DOCUMENTS 3,112,884 A * 12/1963 Gilmour ..... B05B 7/12 137/893
3,191,869 A * 6/1965 Gilmour ..... B05B 7/2443 239/526
3,231,200 A * 1/1966 Heald ..... E03C 1/046 4/596
4,623,095 A * 11/1986 Pronk ..... E03C 1/046 239/311
4,736,891 A * 4/1988 Chow ..... B05B 7/2443 239/318
5,356,076 A * 10/1994 Bishop ..... B05B 7/0425 239/311
6,425,534 B2 * 7/2002 Ketcham ..... B05B 7/2472 137/893

* cited by examiner

*Primary Examiner* — Chee-Chong Lee
(74) *Attorney, Agent, or Firm* — IPro, PLLC

(57) ABSTRACT

A spray device includes a converging assembly, a container and a suction pipe. The converging assembly includes a first liquid channel, a second liquid channel, a first air channel and a second air channel. The first liquid channel and the first air channel communicate with an inlet of the second liquid channel. The second air channel communicates with the container. An end of the suction pipe communicates with the inlet of the second liquid channel, and another end is submerged in a solution in the container. When a liquid flows from the first liquid channel to the second liquid channel, air in the first liquid channel is discharged via the first air channel, the solution is sucked to the second liquid channel through the suction pipe, the solution and the liquid are mixed at the inlet of the second liquid channel, and then are sprayed from the second liquid channel.

17 Claims, 19 Drawing Sheets

SPRAY DEVICE AND SPRAY SYSTEM

CROSS-REFERENCE TO RELATED APPLICATIONS

The present disclosure claims priority of Chinese Patent Application No. 202023067597.1, filed on Dec. 18, 2020, titled "SPRAY DEVICE AND SPRAY SYSTEM", the contents of which are incorporated herein by reference.

TECHNICAL FIELD

The present disclosure relates to the field of agricultural and garden watering tools, and particularly to a spray device and a spray system including the spray device.

BACKGROUND

Spray devices are a kind of apparatus that can turn liquid pesticide, liquid fertilizer or other liquid into mist through suction effect and evenly spray the mist on target objects. In the field of agriculture and garden, the spray devices are important tools for pest control or fertilizer spraying.

In general, prior to spraying, pesticide or fertilizer is mixed with water or other liquid in advance and the mixture is stored in a container of the spray device. And then the spray device sprays the mixture in the container to irrigate crops.

SUMMARY

An embodiment of the present disclosure provides a spray device. The spray device includes a converging assembly, a container and a suction pipe. The converging assembly includes a first liquid channel, a second liquid channel, a first air channel and a second air channel. The first liquid channel and the first air channel communicate with an inlet of the second liquid channel. The second air channel communicates with the container. An end of the suction pipe communicates with the inlet of the second liquid channel, and another end is submerged in a solution in the container. When a liquid flows from the first liquid channel to the second liquid channel, air in the first liquid channel is discharged via the first air channel, the solution is sucked to the second liquid channel through the suction pipe, and the solution and the liquid are mixed at the inlet of the second liquid channel and then are sprayed from the second liquid channel.

Another embodiment of the present disclosure provides a spray system. The spray system includes the aforesaid spray device and a liquid supply device. The liquid supply device is connected to the spray device and configured to supply the liquid to the spray device.

BRIEF DESCRIPTION OF THE DRAWINGS

One or more embodiments are illustrated with the accompanying drawings, which are not intended to limit the embodiments. The elements with the same reference number in the drawings represent same or similar structures. Unless otherwise specified, the figures in the drawings do not constitute the limitation of proportion.

DETAILED DESCRIPTION

Figure 1:
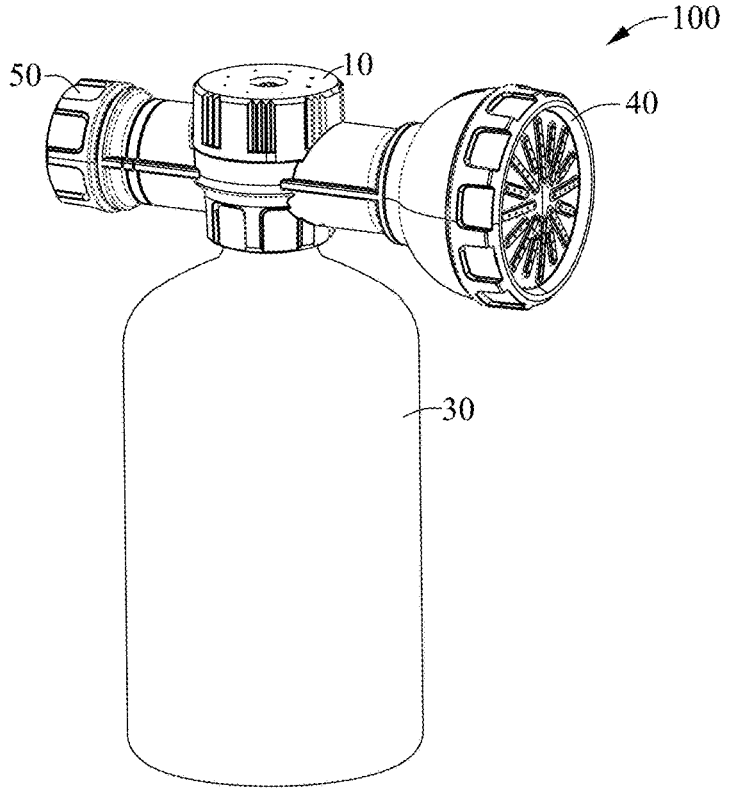
FIG. 1 is a schematic view of a spray device according to an embodiment of the present disclosure.
Figure 2:
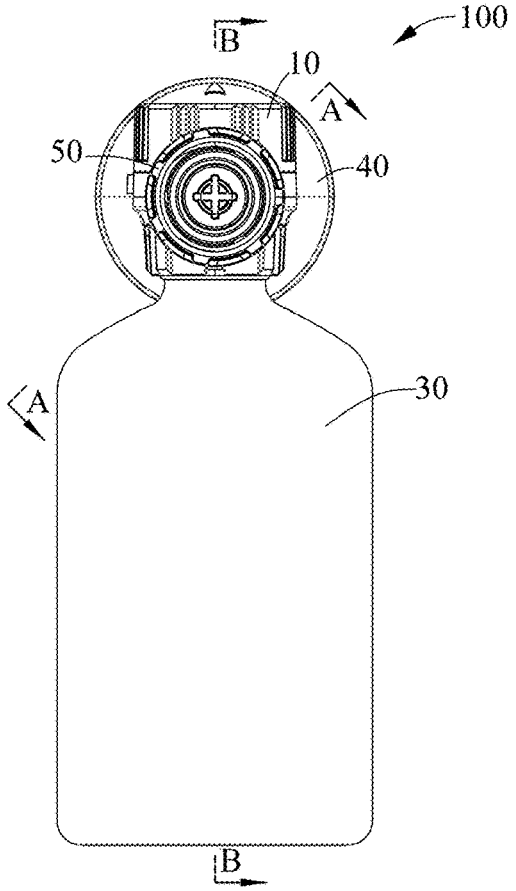
FIG. 2 is a schematic view of the spray device of FIG. 1, viewed from another angle.
Figure 3:
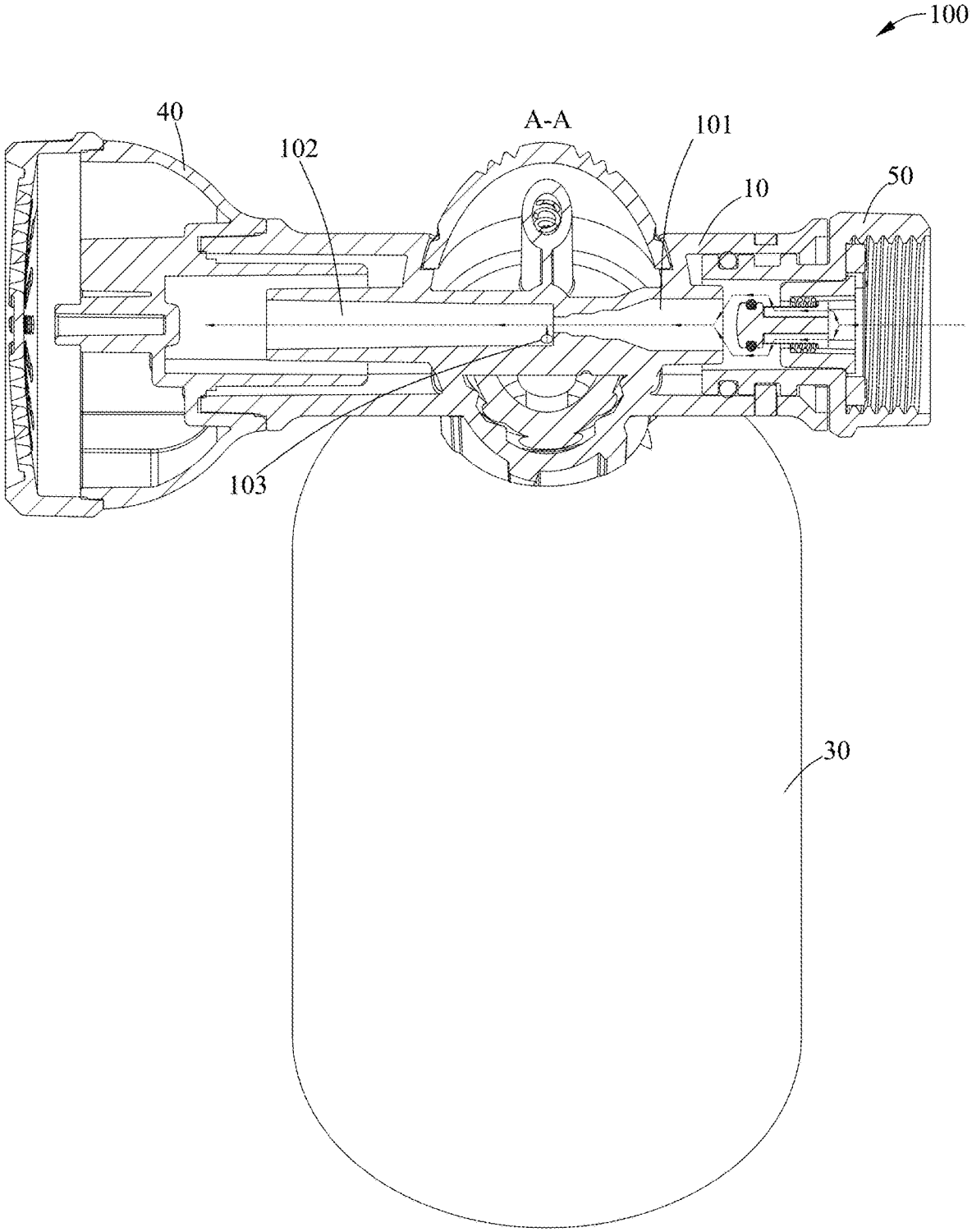
FIG. 3 is a cross-sectional view taken from line A-A in FIG. 2.
Figure 4:
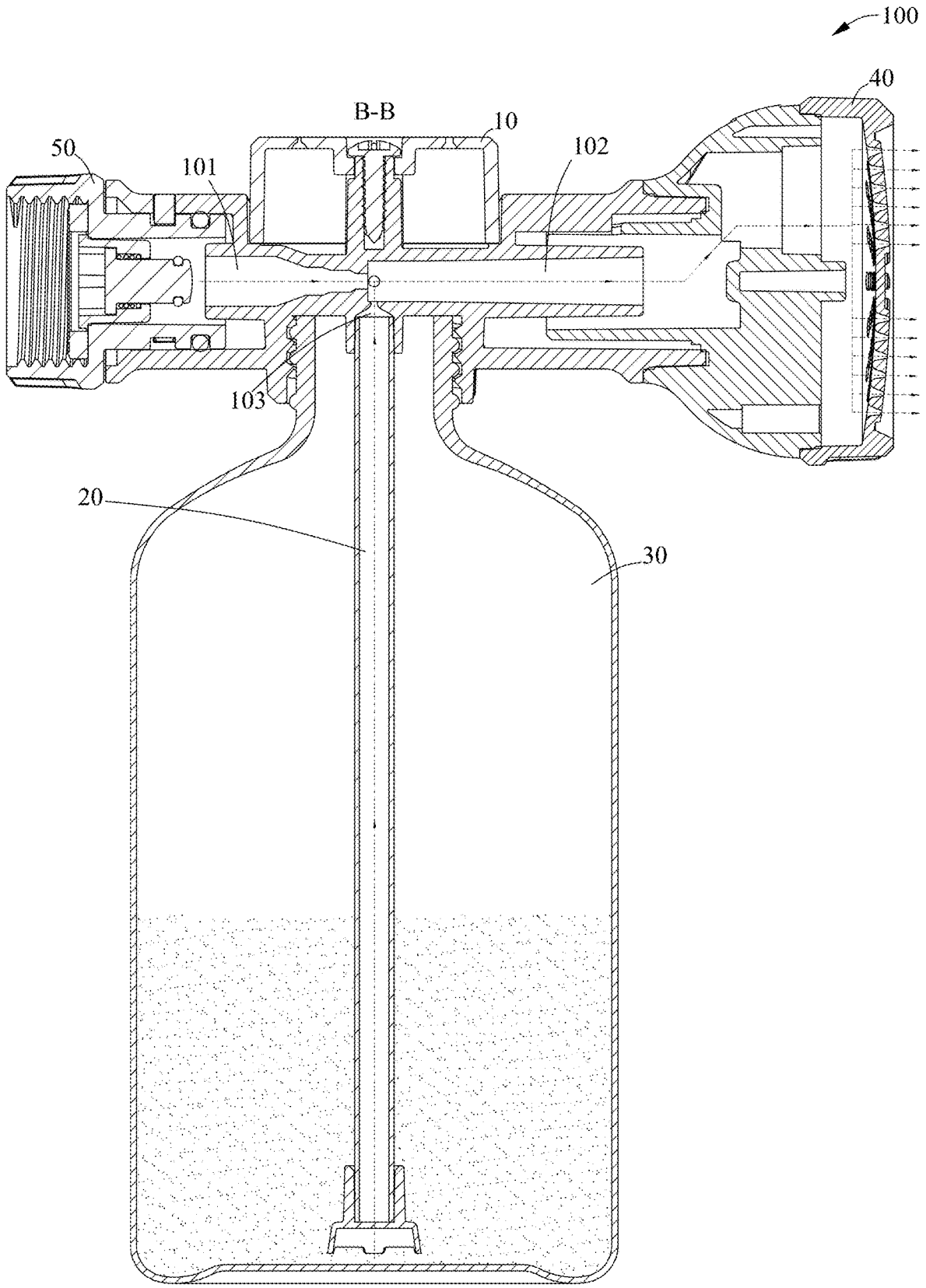
FIG. 4 is a cross-sectional view taken from line B-B in FIG. 2.

To facilitate the understanding of the present disclosure, a more detailed description of the present disclosure is given below in combination with the drawings and specific embodiments. It should be noted that when an element is expressed as "connecting to" another element, it can be directly connected to another element, or there can be one or more intermediates therebetween. Terms used in the specification such as "up", "down", "left", "right", "upper end", "lower end", "top" and "bottom" are based on the orientation or position relationship shown in the figure, only for the convenience of describing the present disclosure and simplifying the description, rather than indicating or implying that the device or element must have a specific orientation and be constructed in a specific orientation. Therefore, it cannot be understood as a limitation of the present disclosure. In addition, the description of "first", "second" and the like in the present disclosure is only for the purpose of description and cannot be understood as indicating or implying their relative importance.

Unless otherwise defined, all technical and scientific terms used in this specification have the same meanings as those commonly understood by those skilled in the technical field of the present disclosure. The terms used in the specification of the present disclosure are only for the purpose of describing specific embodiments, not for limiting the present disclosure.

Referring to FIGS. 1-4, an embodiment of the present disclosure provides a spray device 100, including a converging assembly 10, a suction assembly 20, a container 30, an outlet pipe assembly 40, and an inlet pipe assembly 50.

One end of the suction assembly 20, the container 30, the outlet pipe assembly 40, and the inlet pipe assembly 50 all communicate with the converging assembly 10. The container 30 is configured to accommodate a solution. The other end of the suction assembly 20 is submerged in the solution in the container 30.

The inlet pipe assembly 50 is configured to receive a liquid, and supplies the liquid to the converging assembly 10.

The converging assembly 10 is configured to receive the liquid from the inlet pipe assembly 50 and the solution pumped by the suction assembly 20 from the container 30, and supply the mixture of the liquid and the solution to the outlet pipe assembly 40.

The outlet pipe assembly 40 is configured to receive the mixture of the liquid and the solution from the converging assembly 10, and spray the mixture outwards.

The converging assembly 10 includes a liquid channel. The liquid channel includes a first liquid channel 101, a second liquid channel 102, and a third liquid channel 103. The first liquid channel 101 and the third liquid channel 103 both communicate with the second liquid channel 102.

The first liquid channel 101 includes an inlet communicating with the inlet pipe assembly 50, and an outlet communicating with the second liquid channel 102. The first liquid channel 101 is configured to receive the liquid from the inlet pipe assembly 50 and supplies the liquid to the second liquid channel 102.

In the direction from the inlet of the first liquid channel 101 to the outlet of the liquid channel 101, the diameter of the outlet of the liquid channel 101 is dwindling.

The inlet of the third liquid channel 103 communicates with the suction assembly 20, such that the converging assembly 10 communicates with the suction assembly 20; the outlet of the third liquid channel 103 communicates with the second liquid channel 102.

In the direction from the inlet of the third liquid channel 103 to the outlet of the third liquid channel 103, the diameter of the outlet of the third liquid channel 103 is dwindling.

The inlet of the second liquid channel 102 communicate with the first liquid channel 101 and the third liquid channel 103, and the outlet of the second liquid channel 102 communicate with the outlet pipe assembly 40. The second liquid channel 102 is configured to receive the liquid from the first liquid channel 101 and the solution pumped by the suction assembly 20 and the third liquid channel 103 from the container 30, and to supply the mixture of the liquid and the solution to the outlet pipe assembly 40.

In some embodiments, as needed, the inlet pipe assembly 50 can be omitted. For example, when the inlet pipe assembly 50 is omitted, the liquid is directly introduced to the inlet of the first liquid channel 101. Likewise, as needed, the outlet pipe assembly 40 can be omitted. For example, when the outlet pipe assembly 40 is omitted, the liquid is directly sprayed outwards from the outlet of the second liquid channel 102. Likewise, as needed, the third liquid channel 103 can be omitted. For example, the suction assembly 20 is directly connected to the inlet of the second liquid channel 102.

In certain embodiments, the container 30 is positioned on the bottom end of the converging assembly 10. The weight ratio of the inlet pipe assembly 50 and the outlet pipe assembly 40 is a preset value, such that the gravity centers of the inlet pipe assembly 50, the converging assembly 10, and the outlet pipe assembly 40 are located on the converging assembly 10. When in use, the center of gravity of the spray device 100 is located on the converging assembly 10, such that the outlet pipe assembly 40 is not easy to tilt to adversely affect the spraying angle.

Figure 5:
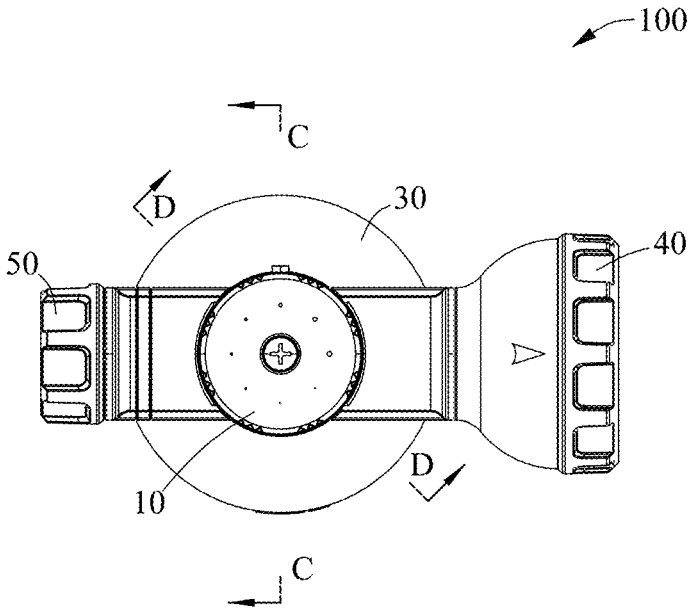
FIG. 5 is a schematic view of the spray device of FIG. 1, viewed from still another angle.
Figure 6:
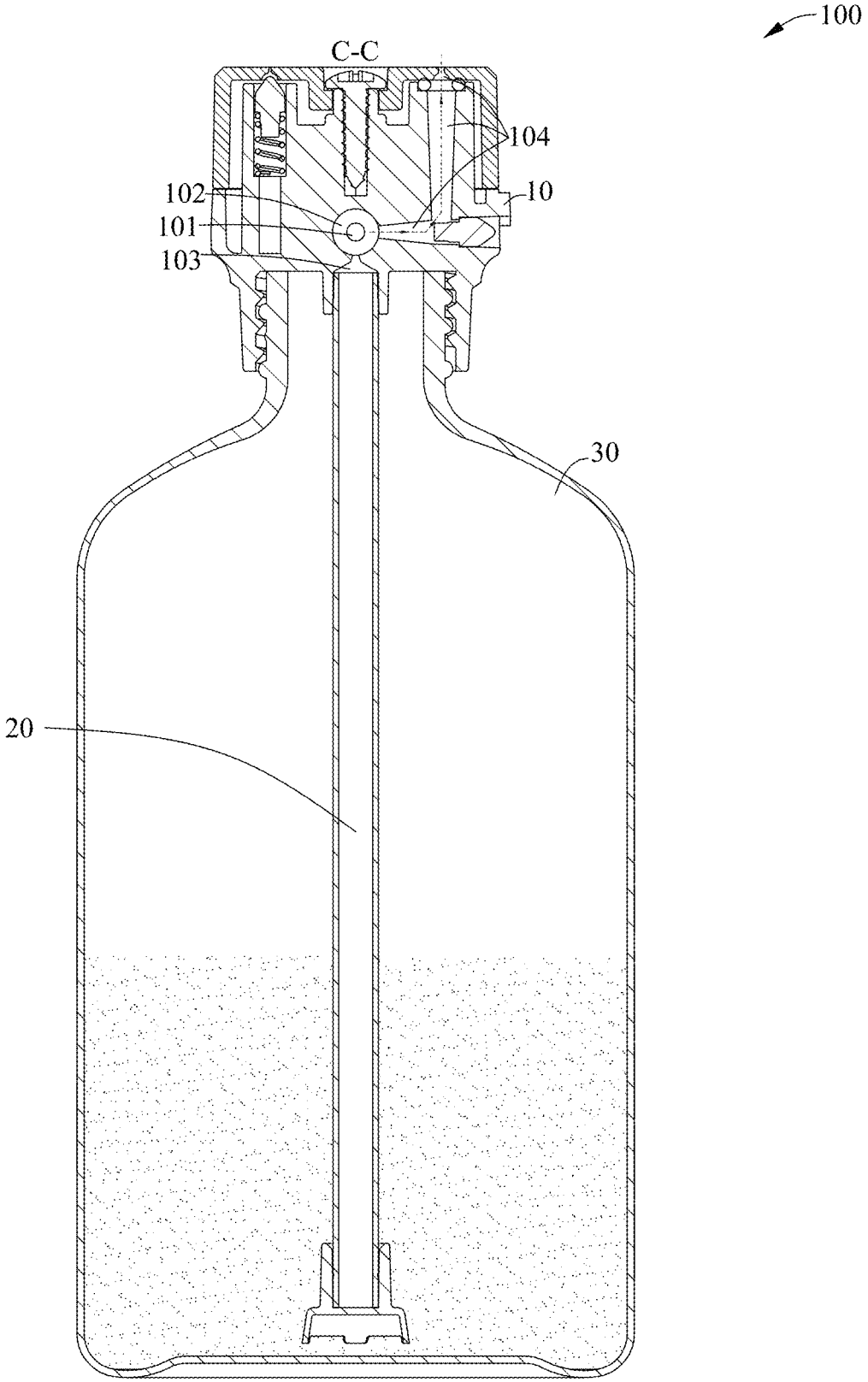
FIG. 6 is a cross-sectional view taken from line C-C in FIG. 5.
Figure 7:
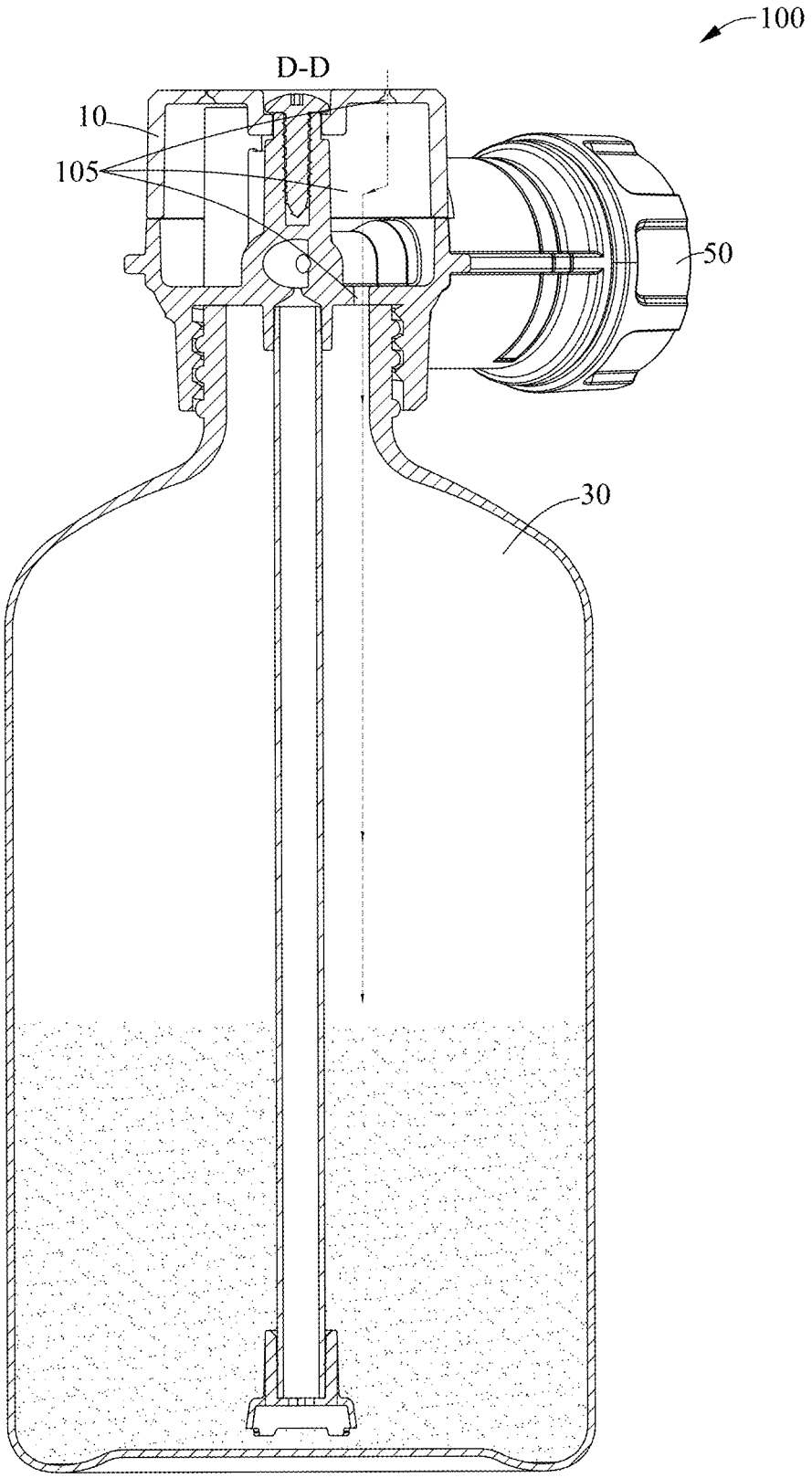
FIG. 7 is a cross-sectional view taken from line D-D in FIG. 5.

Referring to FIGS. 5-7, the converging assembly 10 includes a first air channel 104 and a second air channel 105.

The first air channel 104 communicates with the inlet of the second liquid channel 102, such that the second liquid channel 102 can receive the air from the first liquid channel 101, and spray the air outwards.

The second air channel 105 communicates with the container 30 to balance the air pressure in the container 30.

When the liquid flows to the first liquid channel 101, the liquid extrudes the air in the liquid channel. In this way, a part of the air in the liquid channel is discharged from the outlet pipe assembly 40, and another part of the air in the first liquid channel 101 is discharged by the first air channel 104 whereby a negative pressure is formed in the second liquid channel 102, and then the solution in the container 30 is pumped into the second liquid channel 102. When the solution in the container 30 is pumped to the second liquid channel 102, the external air enters the container 30 via the second air channel 105 to balance the air pressure in the container 30.

Compared with a conventional air channel positioned in the container 30, the second air channel 105 of the present disclosure is positioned in the converging assembly 10, thus improving the tightness of the container 30. When not in use, the solution in the container 30 is not easy to be polluted by air, volatilized or leak, which is conducive to storing the solution in the container 30.

Figure 8:
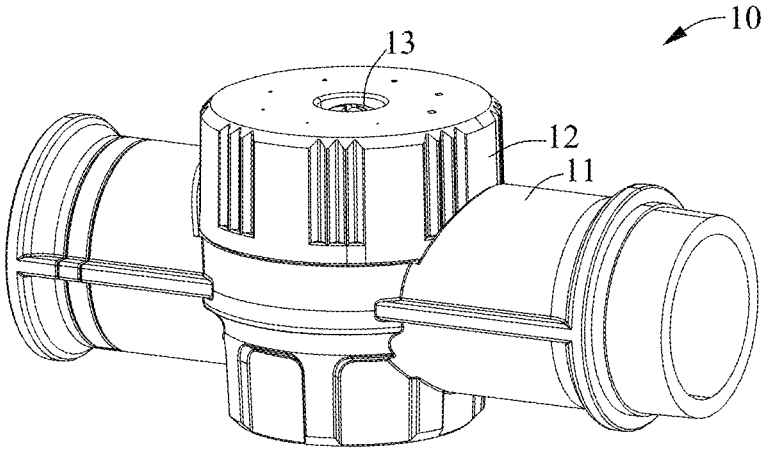
FIG. 8 is a schematic view of a converging assembly of the spray device of FIG. 1.
Figure 9:
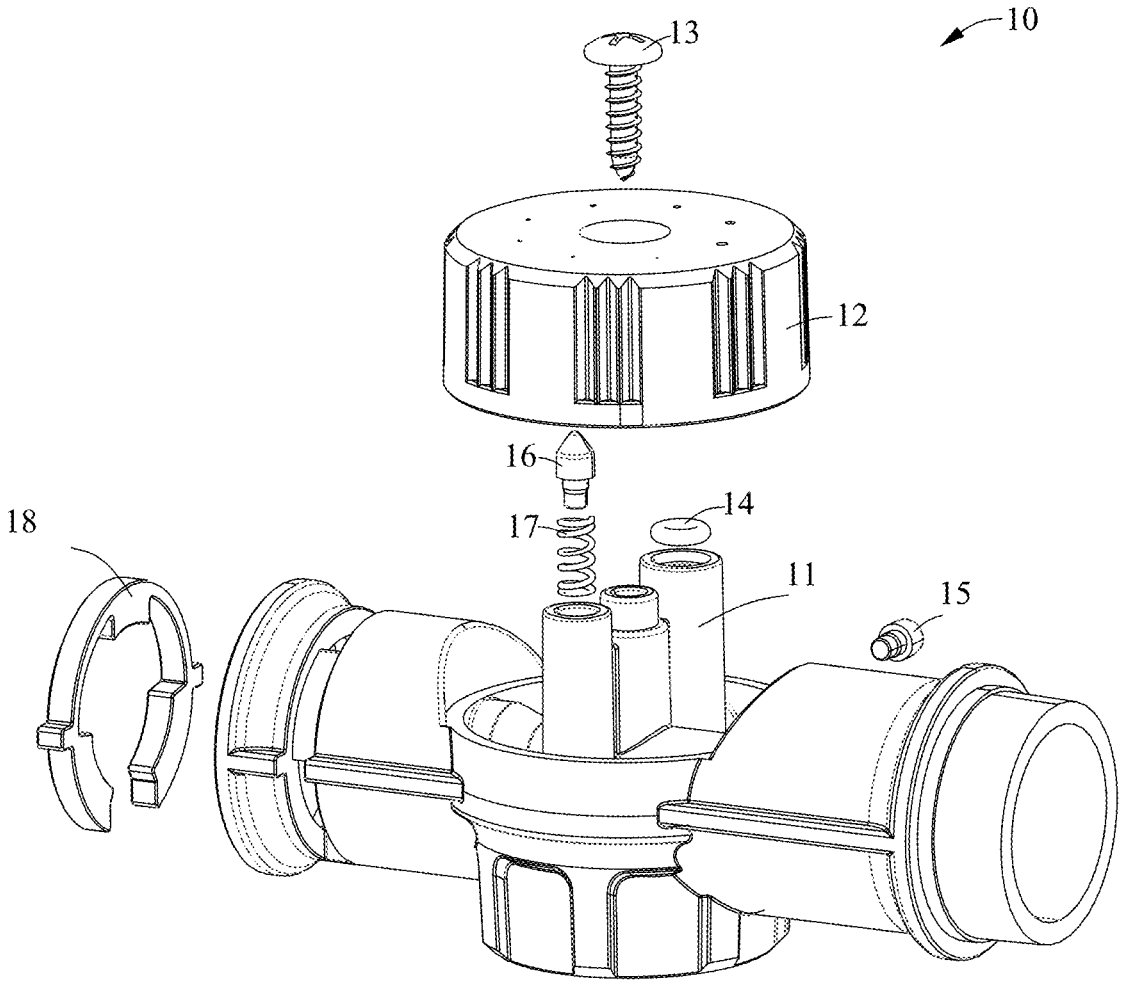
FIG. 9 is an exploded view of the converging assembly of FIG. 8.

Referring to FIGS. 8 and 9, the converging assembly 10 includes a converging part 11, a rotating member 12, a screw 13, a first sealing ring 14, a stopper 15, a sliding member 16, a first elastic member 17, and a clamping member 18.

The rotating member 12, the screw 13, the first sealing ring 14, the stopper 15, the sliding member 16, the first elastic member 17, and the clamping member 18 are all mounted on the converging part 11.

Figure 10:
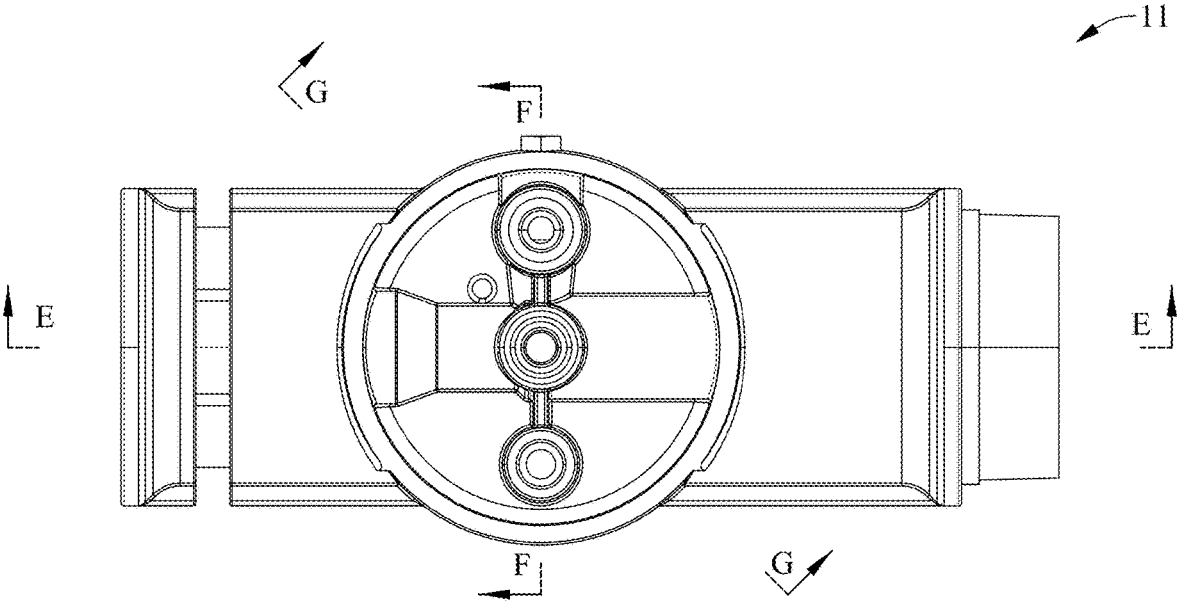
FIG. 10 is a schematic view of a converging part of the converging assembly of FIG. 8.
Figure 11:
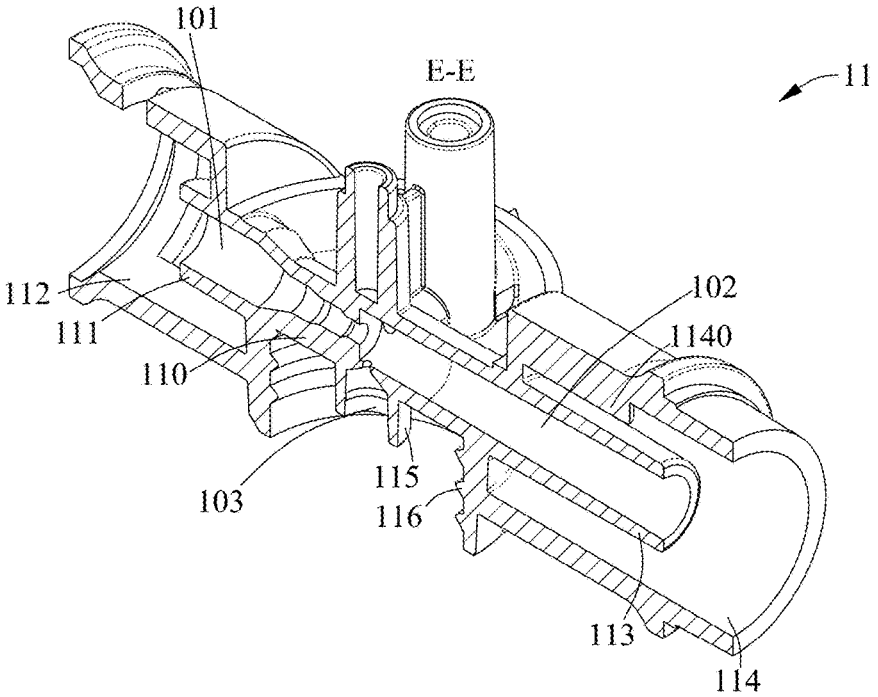
FIG. 11 is a cross-sectional view taken from line E-E in FIG. 10.

Referring to FIGS. 10 and 11, the first liquid channel 101, the second liquid channel 102, and the third liquid channel 103 are all positioned on the converging part 11.

The converging part 11 includes a main body 110, a first tube 111, a first surrounding part 112, a second tube 113, a second surrounding part 114, a third tube 115, and a threaded part 116.

The main body 110 is substantially a cylinder.

The first tube 111 protrudes from a first end of the main body 110.

The first liquid channel 101 passes through the first tube 111 and extends into the main body 110. The inlet of the first liquid channel 101 is positioned in the first tube 111, and the outlet of the first liquid channel 101 is positioned in the main body 110.

The first surrounding part 112 protrudes from the first end of the main body 110, and is on the same side of the main body 110 as the first tube 111. The first surrounding part 112 surrounds the first tube 111, and is spaced apart from the first tube 111.

The second tube 113 protrudes from a second end of the main body 110. Specifically, the second tube 113 and the first tube 111 are respectively positioned on two opposite ends of the main body 110.

The second liquid channel 102 passes through the second tube 113 and extends into the main body 110. The inlet of the second liquid channel 102 is positioned in the main body 110, and the outlet of the second liquid channel 102 is positioned in the second tube 113.

The second surrounding part 114 protrudes from the second end of the main body 110, and is on the same side of the main body 110 as the second tube 113. The second surrounding part 114 surrounds the second tube 113, and is spaced apart from the second tube 113.

The inner wall of the second surrounding part 114 protrudes to form a positioning part 1140. The positioning part 1140 extends along the axial direction of the second surrounding part 114.

The third tube 115 protrudes from the bottom end of the main body 110.

The third liquid channel 103 passes through the third tube 115 and extends into the main body 110. The inlet of the third liquid channel 103 is positioned in the third tube 115, and the outlet of the third liquid channel 103 is positioned in the main body 110.

The threaded part 116 protrudes from the bottom end of the main body 110. The threaded part 116 surrounds the third tube 115, and is spaced apart from the third tube 115.

Figure 12:
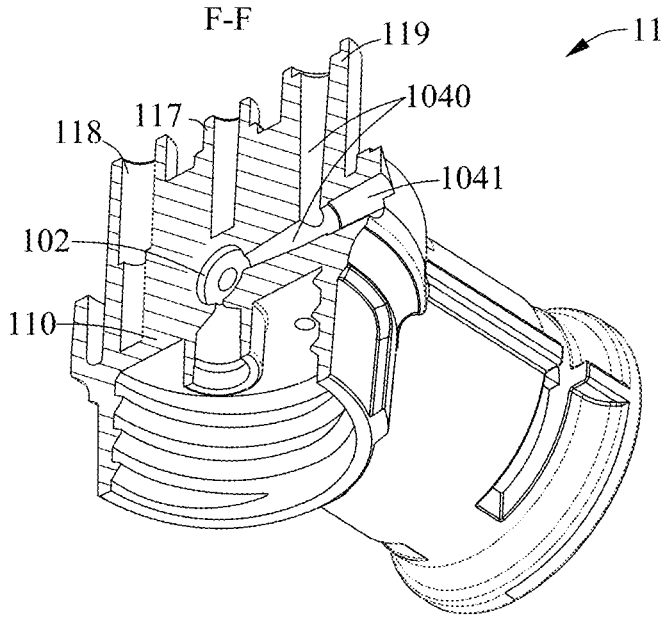
FIG. 12 is a cross-sectional view taken from line F-F in FIG. 10.

Referring to FIG. 12, the converging part 11 further includes a support column 117, a mounting cavity 118, and an air tube 119.

The support column 117, the mounting cavity 118, and the air tube 119 are all positioned on the top of the main body 110. The support column 117 is located between the mounting cavity 118 and the air tube 119.

Reinforcing ribs are positioned between the support column 117 and the mounting cavity 118, and between the support column 117 and the air tube 119, which is conducive to improving the stability between the support column 117, the mounting cavity 118 and the air tube 119.

The converging part 11 defines an air passage 1040. The inlet of the air passage 1040 communicates with the inlet of the second liquid channel 102. The air passage 1040 passes through the air tube 119 and extends into the main body 110. The inlet of the air passage 1040 is positioned on the main body 110, and the outlet of the air passage 1040 is positioned on the air tube 119.

An included angle between the orientation of the inlet of the air passage 1040 and the orientation of the outlet of the air passage 1040 is basically 90 degrees. The converging part 11 includes a mold opening 1041 communicating with the inlet of the air passage 1040. The mold opening 1041 is used for passing a mold to shape the inlet of the air passage 1040.

Figure 13:
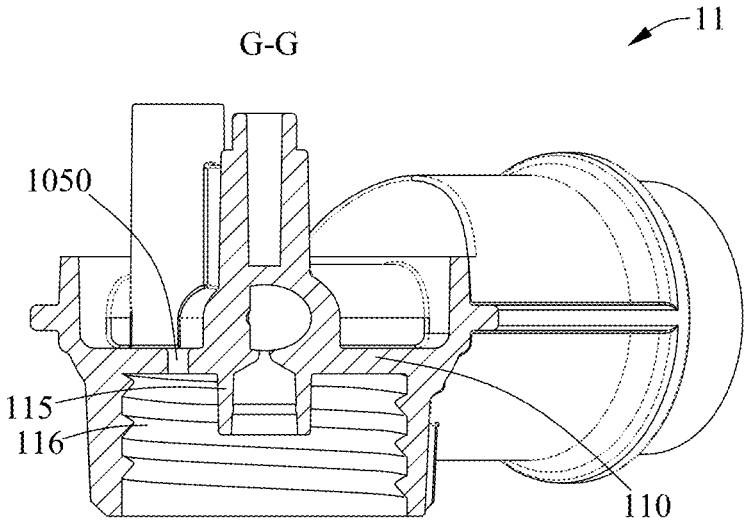
FIG. 13 is a cross-sectional view taken from line G-G in FIG. 10.

Referring to FIG. 13, the converging part 11 includes a communication hole 1050.

The communication hole 1050 passes through the top and bottom of the main body 110 and located between the third tube 115 and the threaded part 116.

Figure 14:
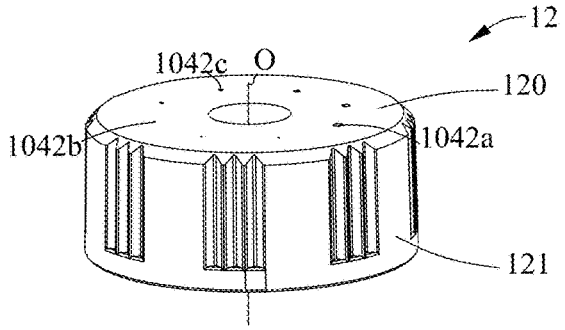
FIG. 14 is a schematic view of a rotating member of the converging assembly of FIG. 9.

Referring to FIG. 14, the rotating member 12 has a central axis O.

The rotating member 12 defines a plurality of air vents positioned spaced apart around the central axis O. The diameters of the plurality of air vents are different from each other. In this illustrated embodiment, three air vents are illustrated, that is, a first air vent 1042*a*, a second air vent 1042*b*, and a third air vent 1042*c*.

The first air vent 1042*a*, the second air vent 1042*b*, and the third air vent 1042*c* are positioned spaced apart around the central axis O, and the diameters of the first air vent 1042*a*, the second air vent 1042*b*, and the third air vent 1042 care different from each other.

The rotating member 12 includes a base wall 120 and an enclosing wall 121 surrounding the base wall 120. The first air vent 1042*a*, the second air vent 1042*b*, and the third air vent 1042*c* pass through the base wall 120.

Figure 15:
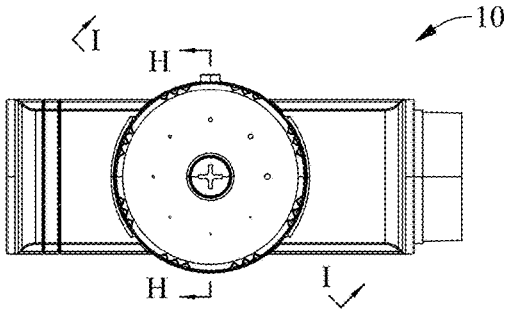
FIG. 15 is a schematic view of the converging assembly of FIG. 8, viewed from another angle.
Figure 16:
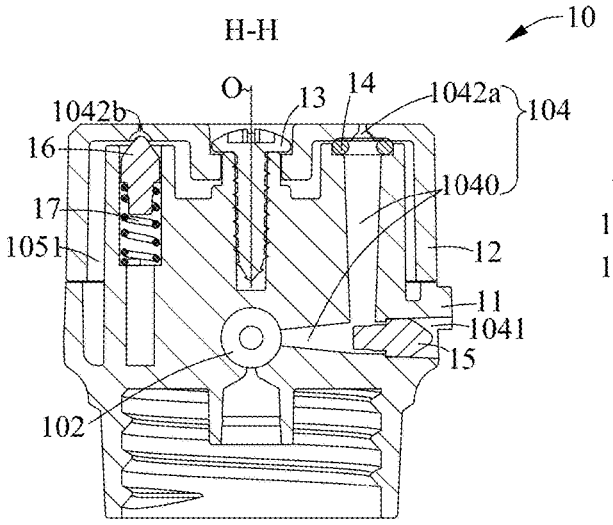
FIG. 16 is a cross-sectional view taken from line H-H in FIG. 15.

Referring to FIGS. 15 and 16, the rotating member 12 is rotatable around the central axis O relative to the converging part 11, such that the first air vent 1042*a* communicates with the outlet of the air passage 1040, or the second air vent 1042*b* communicates with the outlet of the air passage 1040, or the rotating member 12 closes the outlet of the air passage 1040.

The air passage 1040 and the air vent connected thereto form the first air channel 104. For example, when the air passage 1040 communicates with the first air vent 1042*a*, the air passage 1040 and the first air vent 1042*a* form the first air channel 104.

When the liquid flows in the first liquid channel 101, a part of air in the first liquid channel 101 flows from the second liquid channel 102 to the air passage 1040, and the air in the air passage 1040 is discharged to the outside through an air vent communicating with the air passage 1040. The air passage 1040 can alternately communicate with the air vents with different diameters thus controlling the flow speed of the air in the air passage 1040, so as to control the flow rate of the liquid in the first liquid channel 101 and the second liquid channel 102, thus indirectly controlling the speed of the liquid spraying to the outside. In the related art, the spraying speed of the liquid is controlled by adjusting the diameter of the liquid outlet. However, in use, adjusting the diameter of the liquid outlet encounters large resistance, so it is generally necessary to stop the operation of the liquid spraying. Compared with the way of adjusting the liquid spraying speed by adjusting the diameter of the liquid outlet, the resistance encountered by adjusting the diameter of the air vent is gas resistance, which is small and can be adjusted in the process of liquid spraying.

The screw 13 is configured to prevent the rotating member 12 from detaching from the converging part 11.

The first sealing ring 14 is positioned at the outlet of the air passage 1040, and is used for sealing the joint of the air passage 1040 and one of the first air vent 1042*a*, the second air vent 1042*b*, and the third air vent 1042*c*.

The stopper 15 is positioned in the mold opening 1041 to block the mold opening 1041.

The sliding member 16 is movable relative to the converging part 11. When the rotating member 12 rotates and the air passage 1040 communicates with the second air vent 1042*b*, the second air vent 1042*b* is located on the moving track of the sliding member 16 relative to the converging part 11. Thus, the sliding member 16 moves relative to the converging part 11 and falls into the second air vent 1042*b* thus preventing the rotation of the rotating member 12. When the rotating member 12 blocks the outlet of the air passage 1040, any air vent is not on the moving track of the sliding member 16 relative to the converging part 11.

The first elastic member 17 is configured to provide an elastic force to drive the sliding member 16 to move into the second air vent 1042*b* and keep the sliding member into the second air vent 1042*b*. Optionally, the first elastic part 17 is a compression spring.

The converging assembly 10 includes the sliding member 16 and the first elastic member 17. When a user rotates the rotating member 12, the position of the rotating member 12 relative to the converging part 11 is determined by whether the sliding part 16 is trapped in the air vent, so as to know whether the outlet of the air passage 1040 communicates with one air vent, and in some extent, to fix the converging part 11 and the rotating member 12.

The rotating member 12 and the converging part 11 cooperatively define an air chamber 1051.

Figure 17:
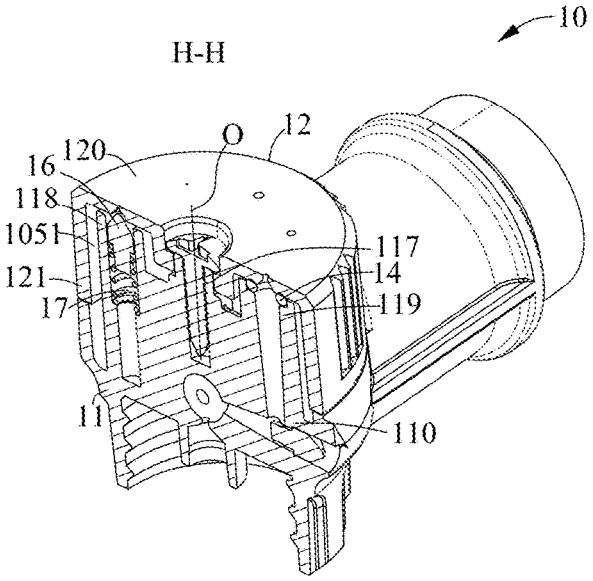
FIG. 17 is a cross-sectional view taken from line H-H in FIG. 15, viewed from another angle.

Referring to FIG. 17, the base wall 120 and the top part of the main body 110 are positioned on two opposite ends of the air chamber 1051. The enclosing wall 121 surrounds the air chamber 1051 and is positioned between the base wall 120 and the top part of the main body 110.

The support column 117, the mounting cavity 118, and the air tube 119 are all positioned in the air chamber 1051. The center line of the support column 117 coincides with the central axis O, and the support column 117 is sheathed in the base wall 120 such that the rotating member 12 is rotatably positioned on the converging part 11.

The stem of the screw 13 passes through the base wall 120 and is in threaded connection to the support column 117. The head of the screw 13 abuts against the base wall 120 to prevent the base wall 120 from separating from the support column 117.

One end of the mounting cavity 118 is connected to the top part of the main body 110, and the other end is attached to the base wall 120.

The sliding member 16 and the first elastic member 17 are both positioned in the mounting cavity 118, and the first elastic member 17 is positioned between the sliding member 16 and an inner sidewall of the mounting cavity 118.

One end of the air tube 119 is connected to the top part of the main body 110, and the other end is attached to the base wall 120.

The first sealing ring 14 partially protrudes the end of the air tube 119 close to the base wall 120, and abuts against the base wall 120.

Figure 18:
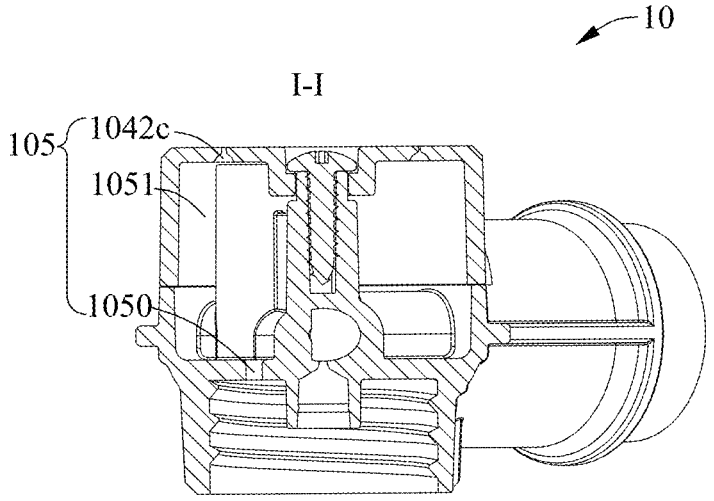
FIG. 18 is a cross-sectional view taken from line I-I in FIG. 15.

Referring to FIG. 18, the third air vent 1042*c* communicates with the communication hole 1050 through the air chamber 1051, such that the third air vent 1042*c*, the air chamber 1051, and the communication hole 1050 form the second air channel 105.

Figure 19:
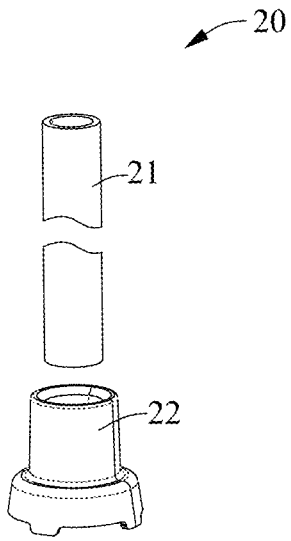
FIG. 19 is an exploded view of a suction assembly of the spray device of FIG. 1.

Referring to FIG. 19, the suction assembly 20 includes a suction pipe 21 and a filter 22. The suction pipe 21 is positioned on one end of the filter 22.

The filter 22 is positioned around the suction pipe 21. The filter 22 and the suction pipe 21 are in interference fit to fix the filter 22 and the suction pipe 21 together.

Figure 20:
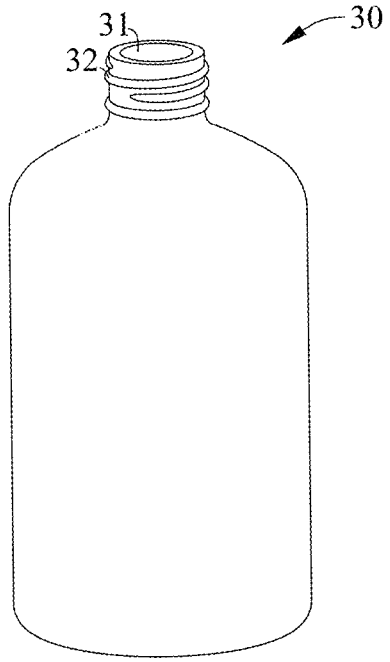
FIG. 20 is a schematic view of a container of the spray device of FIG. 1.

Referring to FIG. 20, the container 30 includes a neck 31 and an outer wall of the neck 31 includes external screw thread 32.

Figure 21:
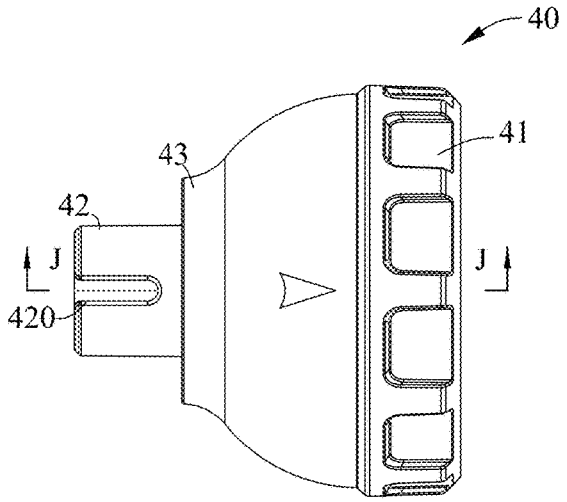
FIG. 21 is a schematic view of an outlet pipe assembly of the spray device of FIG. 1.
Figure 22:
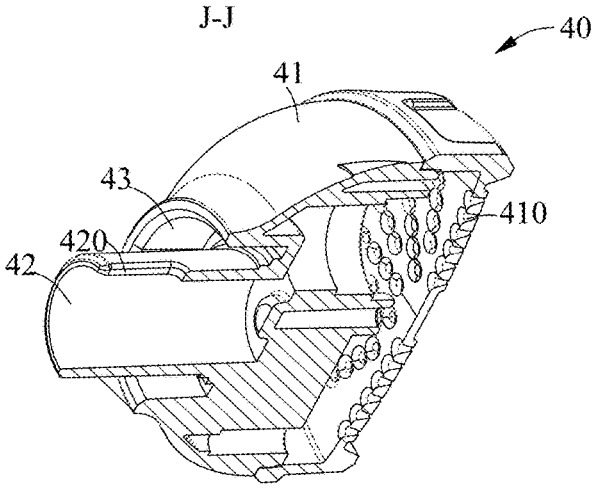
FIG. 22 is a cross-sectional view taken from line J-J in FIG. 21.

Referring to FIGS. 21 and 22, the outlet pipe assembly 40 includes a liquid chamber 41, an outlet pipe 42, and an annular body 43 surrounding the outlet pipe 42.

The liquid chamber 41 defines a plurality of sieve pores 410.

The outlet pipe 42 protrudes out of the liquid chamber 41 and is back on the plurality of sieve pores 410. The outlet pipe 42 communicates with the liquid chamber 41.

One end of the outlet pipe 42 is connected to the liquid chamber 41, and the other end extends in the direction away from the liquid chamber 41. The end of the outlet pipe 42 away from the liquid chamber 41 is provided with a limit groove 420.

The annular body 43 is positioned outside the liquid chamber 41, and on the same of the liquid chamber 41 as the outlet pipe 42. The annular body 43 surrounds the outlet pipe 42 and is spaced apart from the outlet pipe 42.

Figure 23:
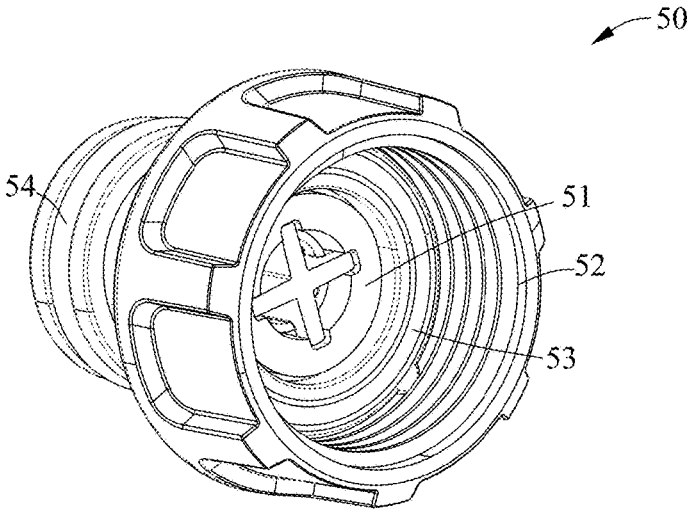
FIG. 23 is a schematic view of an inlet pipe assembly of the spray device of FIG. 1.
Figure 24:
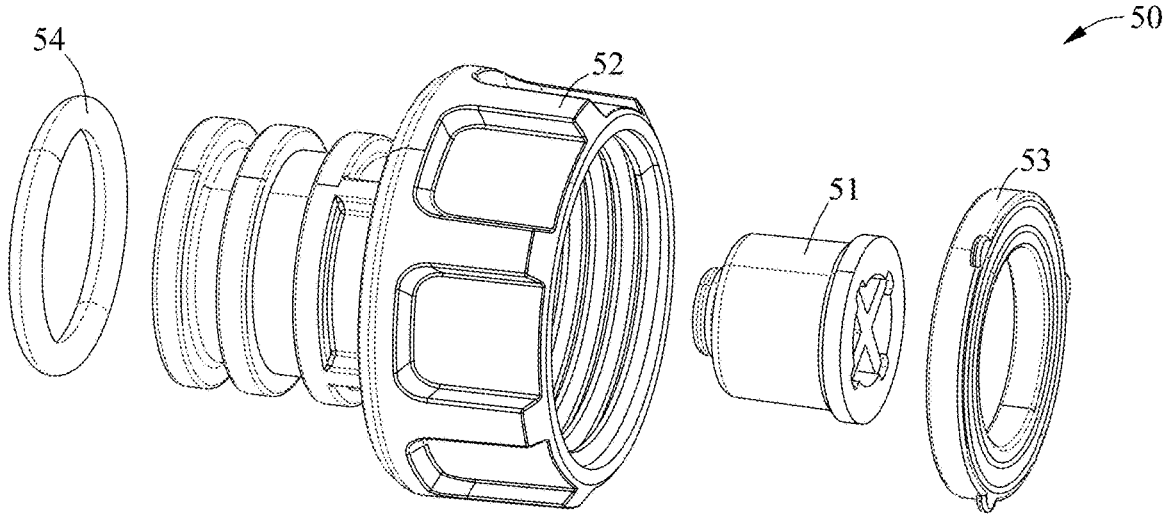
FIG. 24 is an exploded view of the inlet pipe assembly of FIG. 23.

Referring to FIGS. 23 and 24, the inlet pipe assembly 50 includes a check valve 51, a liquid inlet pipe 52, a gasket 53 and a second sealing ring 54.

The liquid inlet pipe 52 is configured to receive liquid. Thus, the inlet pipe assembly 50 receives liquid from outside.

The check valve 51 is configured to open the liquid inlet pipe 52 spontaneously when the liquid inlet pipe 52 receives liquid, and close the liquid inlet pipe 52 spontaneously when the liquid inlet pipe 52 stops receiving the liquid.

Figure 25:
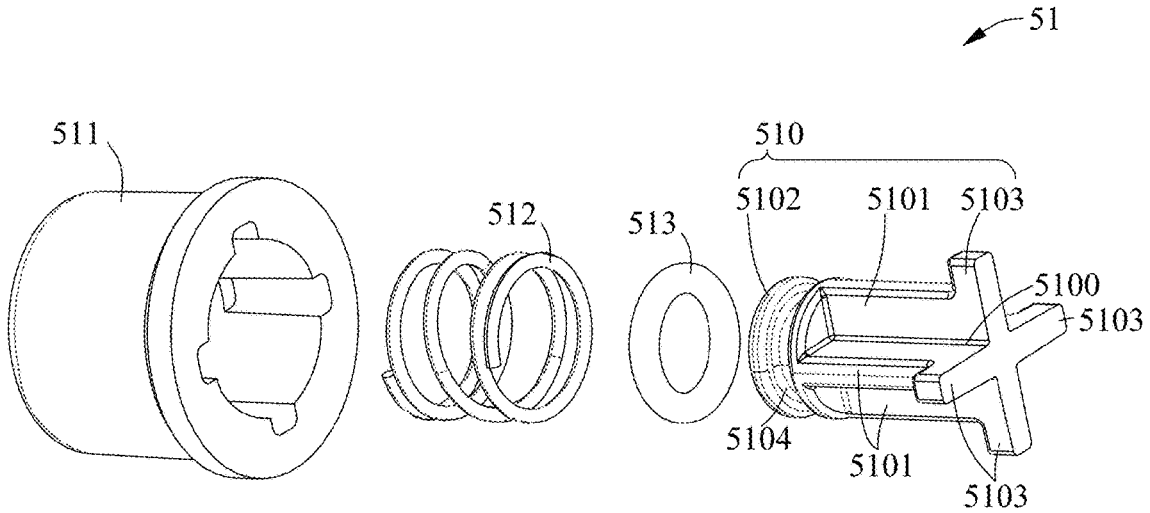
FIG. 25 is an exploded view of a check valve of the inlet pipe assembly of FIG. 23.

Referring to FIG. 25, the check valve 51 includes a piston 510, a bushing 511, a second elastic member 512, and a third sealing ring 513.

The piston 510 is sheathed in the bushing 511 and is movable between a first moving position and a second moving position along the bushing 511.

When the piston 510 moves along the bushing 511 to the first moving position, the piston 510 closes the bushing 511.

When the piston 510 moves along the bushing 511 to the second moving position, the bushing 511 is open.

The second elastic member 512 is configured to provide an elastic force for driving the piston 510 to move to the first moving position and keep the piston 510 in the first moving position.

The piston 510 includes a fork part 5101, a stop part 5102, and a guide part 5103.

The fork part 5101 is basically a long cuboid structure. In certain embodiments, the check valve 51 includes a plurality of fork parts 5101, and the plurality of fork parts 5101 converges at a convergence point 5100.

One end of each fork part 5101 is connected to the stop part 5102, and the other end of each fork part 5101 extends away from the convergence point 5100 to form the guide part 5103.

One end of the stop part 5102 is connected to the plurality of fork parts 5101, and the other end of the stop part 5102 extends in the direction away from the plurality of fork parts 5101. The part between two ends of the stop part 5102 is provided with a plurality of circumferential grooves 5104.

Figure 26:
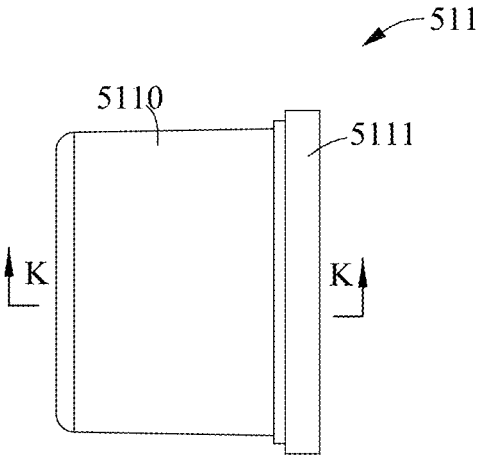
FIG. 26 is a schematic view of a bushing of the check valve of FIG. 25.
Figure 27:
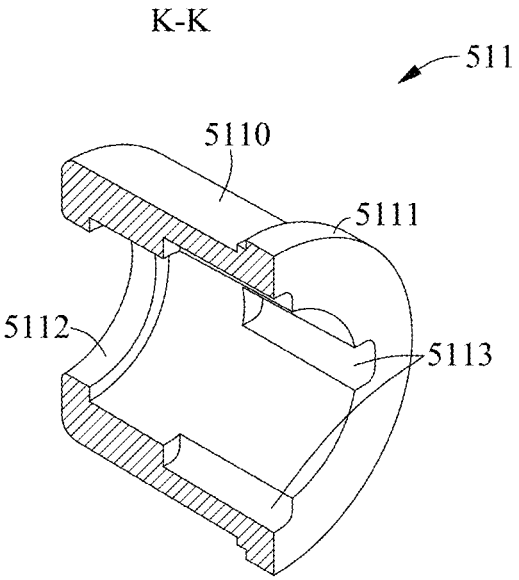
FIG. 27 is a cross-sectional view taken from line K-K in FIG. 26.

Referring to FIGS. 26 and 27, the bushing 511 includes a body 5110, an outer ring part 5111, and an inner ring part 5112.

The body 5110 is substantially a hollow cylindrical structure.

The outer ring part 5111 protrudes from the outer wall on a first end of the body 5110, and the inner ring part 5112 protrudes from the inner wall on a second end of the body 5110. The first end and the second end are two opposite ends of the body 5110.

The inner wall on the first end of the body 5110 close to the outer ring part 5111 is provided with a plurality of guide grooves 5113. Each guide groove 5113 is positioned along the axial direction of the body 5110. One end of the guide groove 5113 is close to the inner ring part 5112, and the other end of the guide groove 5113 is away from the inner ring part 5112. The plurality of guide grooves 5113 are spaced apart along the circumference of the body 5110.

Figure 28:
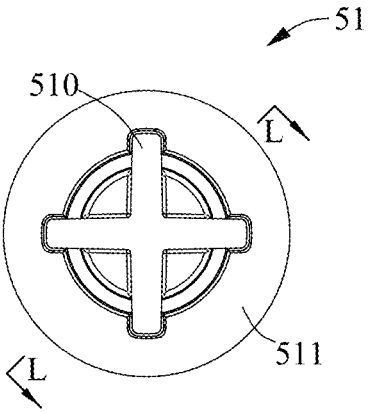
FIG. 28 is a schematic view of the check valve of FIG. 25.
Figure 29:
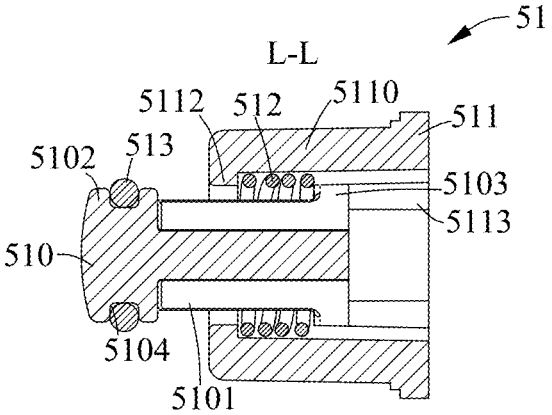
FIG. 29 is a cross-sectional view taken from line L-L in FIG. 28.

Referring to FIGS. 28 and 29, the plurality of fork parts 5101 is received in the body 5110. The guide parts 5103 of the plurality of fork parts 5101 are received in the plurality of guide grooves 5113, respectively. The guide parts 5103 of the plurality of fork parts 5101 are movable with respect to the plurality of guide grooves 5113, such that the piston 510 moves with respect to the bushing 511.

The stop part 5102 extends out of the body 5110 via the inner ring part 5112.

One end of the stop part 5102 connected to the plurality of fork parts 5101 is configured to block the inner ring part 5112.

The third sealing ring 513 is received in one of the plurality of circumferential grooves 5104 and partially protrudes from the stop part 5102. The protrusion of the third sealing ring 513 on the stop part 5102 abuts against the inner ring part 5112 thus preventing the stop part 5102 from completely entering the body 5110.

The second elastic member 512 surrounds the plurality of fork parts 5101 and is received in the body 5110. One end of the second elastic member 512 abuts against the inner ring part 5112, and the other end abuts against the guide parts 5103 of the plurality of fork parts 5101.

When the piston 510 moves to the first moving position, the guide parts 5103 of the plurality of fork parts 5101 move to the ends of the plurality of guide grooves 5113 close to the inner ring part 5112, and abut against the ends of the plurality of guide grooves 5113 close to the inner ring part 5112, so as to prevent the piston 510 from further moving. The second elastic member 512 is compressed, and the stop part 5102 is completely separated from the inner ring part 5112. The inner ring part 5112 surrounds the plurality of fork parts 5101, and the liquid passes through the gap between the inner ring part 5112 and the plurality of fork parts 5101.

Figure 30:
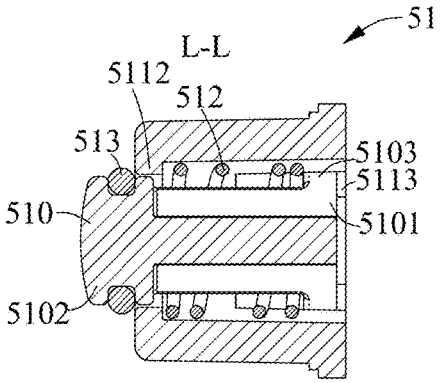
FIG. 30 is a cross-sectional view taken from line L-L in FIG. 28, viewed from another angle.

Referring to FIG. 30, when the piston 510 moves to the second moving position, the second elastic member 512 recovers, and the guide parts 5103 of the plurality of fork parts 5101 move to the ends of the plurality of the guide grooves 5113 away from the inner ring part 5112. The inner ring part 5112 surrounds the end of the stop part 5102 connected to the plurality of fork parts 5101, and thus the inner ring part 5112 basically blocks the stop part 5102. The third sealing ring 513 abuts against the inner ring part 5112 to prevent the piston 510 from further moving and block the gap between the inner ring part 5112 and the stop part 5102.

Figure 31:
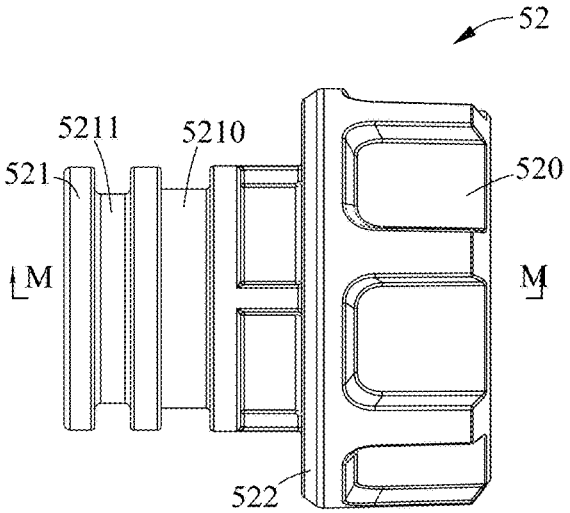
FIG. 31 is a schematic view of a liquid inlet pipe of the inlet pipe assembly of FIG. 23.
Figure 32:
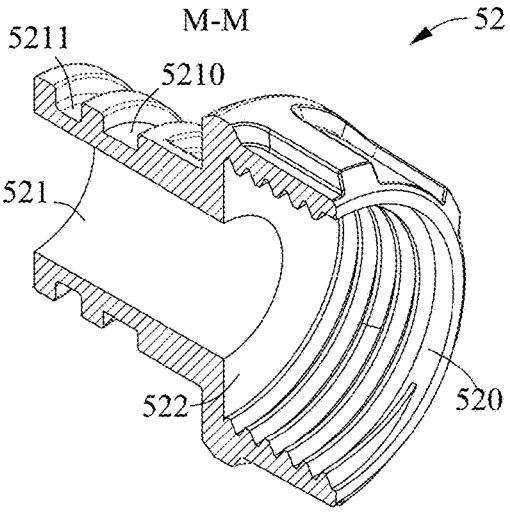
FIG. 32 is a cross-sectional view taken from line M-M in FIG. 31.

Referring to FIGS. 31 and 32, the liquid inlet pipe 52 includes an internal thread section 520, a connection section 521, and an annular transition section 522.

The inner wall of one end of the internal thread section 520 is connected to the outer wall of the annular transition section 522; the outer wall of one end of the connection section 521 is connected to the inner wall of the annular transition section 522, and the other end of the connection section 521 extends away from the internal thread section 520.

The outer wall of the connection section 521 includes a first annular groove 5210 and a second annular groove 5211 along the circumferential direction of the outer wall. The first annular groove 5210 and the second annular groove 5211 are spaced apart along the axial direction of the connection section 521. The first annular groove 5210 is closer to the internal thread section 520 than the second annular groove 5211.

Figure 33:
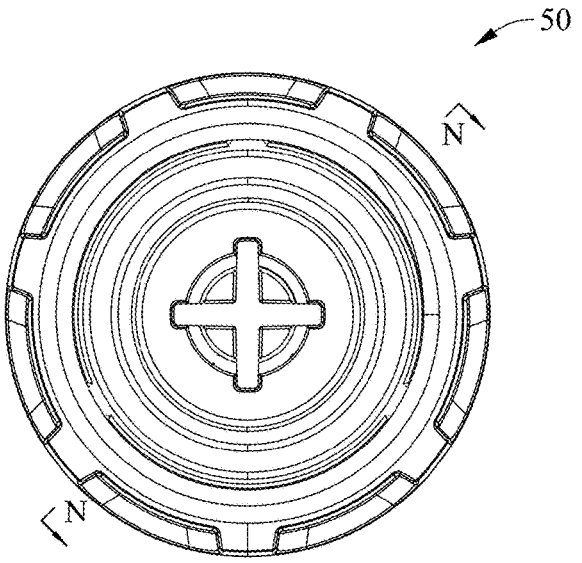
FIG. 33 is a schematic view of the inlet pipe assembly of FIG. 23, viewed from another angle.
Figure 34:
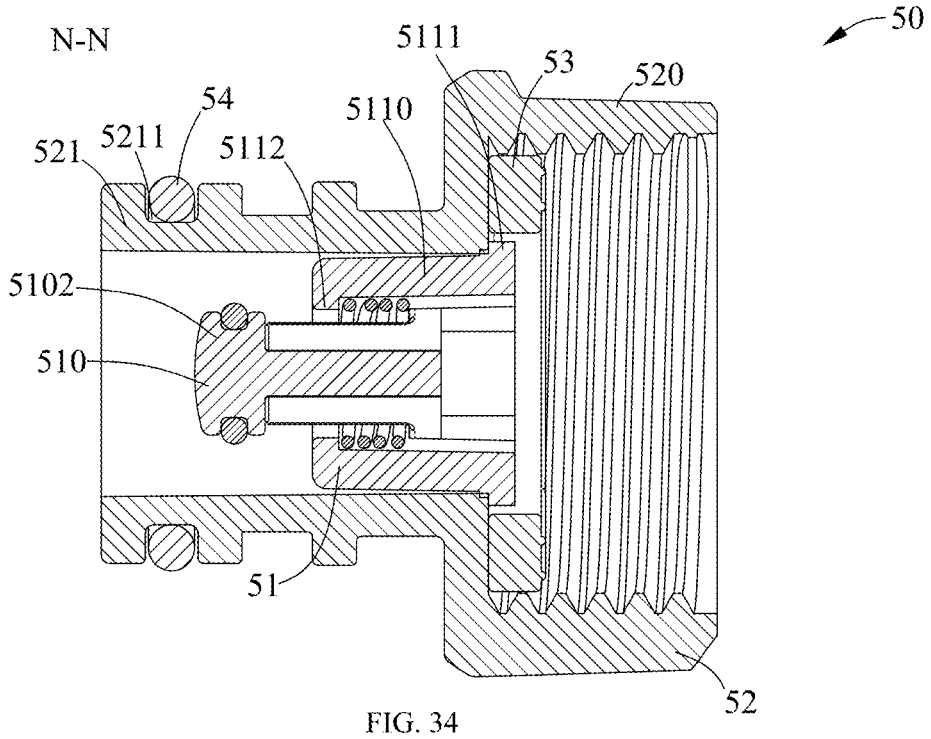
FIG. 34 is a cross-sectional view taken from line N-N in FIG. 33.

Referring to FIGS. 33 and 34, the end of the body 5110 including the inner ring part 5112 extends into the connection section 521 through the internal thread section 520 and the annular transition section 522. The outer ring part 5111 abuts against the annular transition section 522 to prevent the body 5110 from completely extending into the connection section 521.

The gasket 53 is sheathed in the internal thread section 520 and abuts against the annular transition section 522. The gasket 53 surrounds the outer ring part 5111 and the body 5110. The second sealing ring 54 is positioned in the second annular groove 5211 and partially protrudes from the outer wall of the connection section 521.

When the liquid inlet pipe 52 receives liquid, the liquid pushes the stop part 5102 to enable the piston 510 to move to the first moving position, such that the check valve 51 can open the liquid inlet pipe 52 spontaneously.

Figure 35:
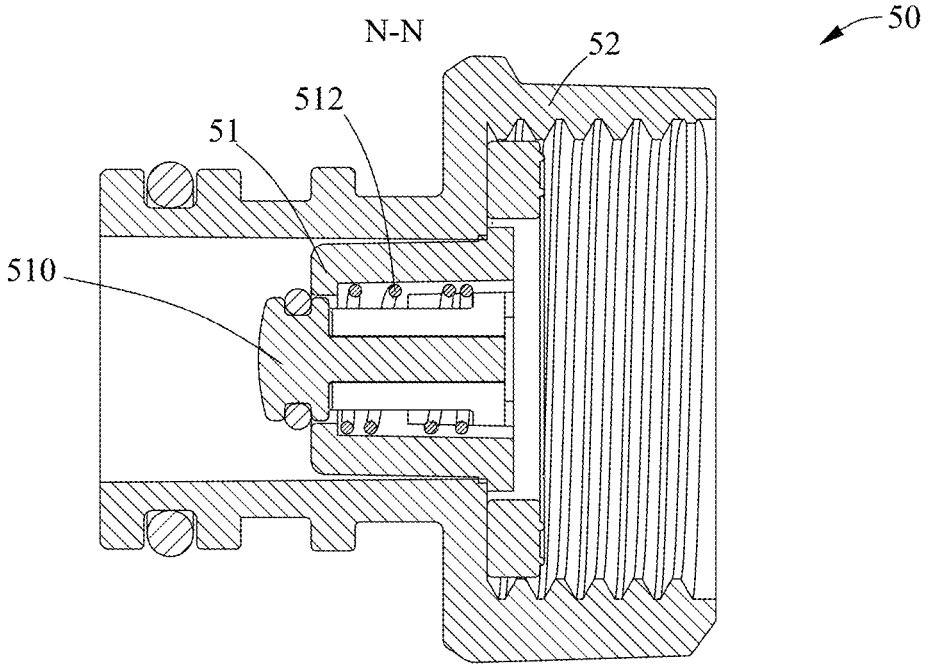
FIG. 35 is a cross-sectional view taken from line N-N in FIG. 33, viewed from another angle.

Referring to FIG. 35, when the liquid inlet pipe 52 stops receiving liquid, the second elastic member 512 drives the piston 510 to move to the second moving position, such that the check valve 51 can close the liquid inlet pipe 52 spontaneously.

Figure 36:
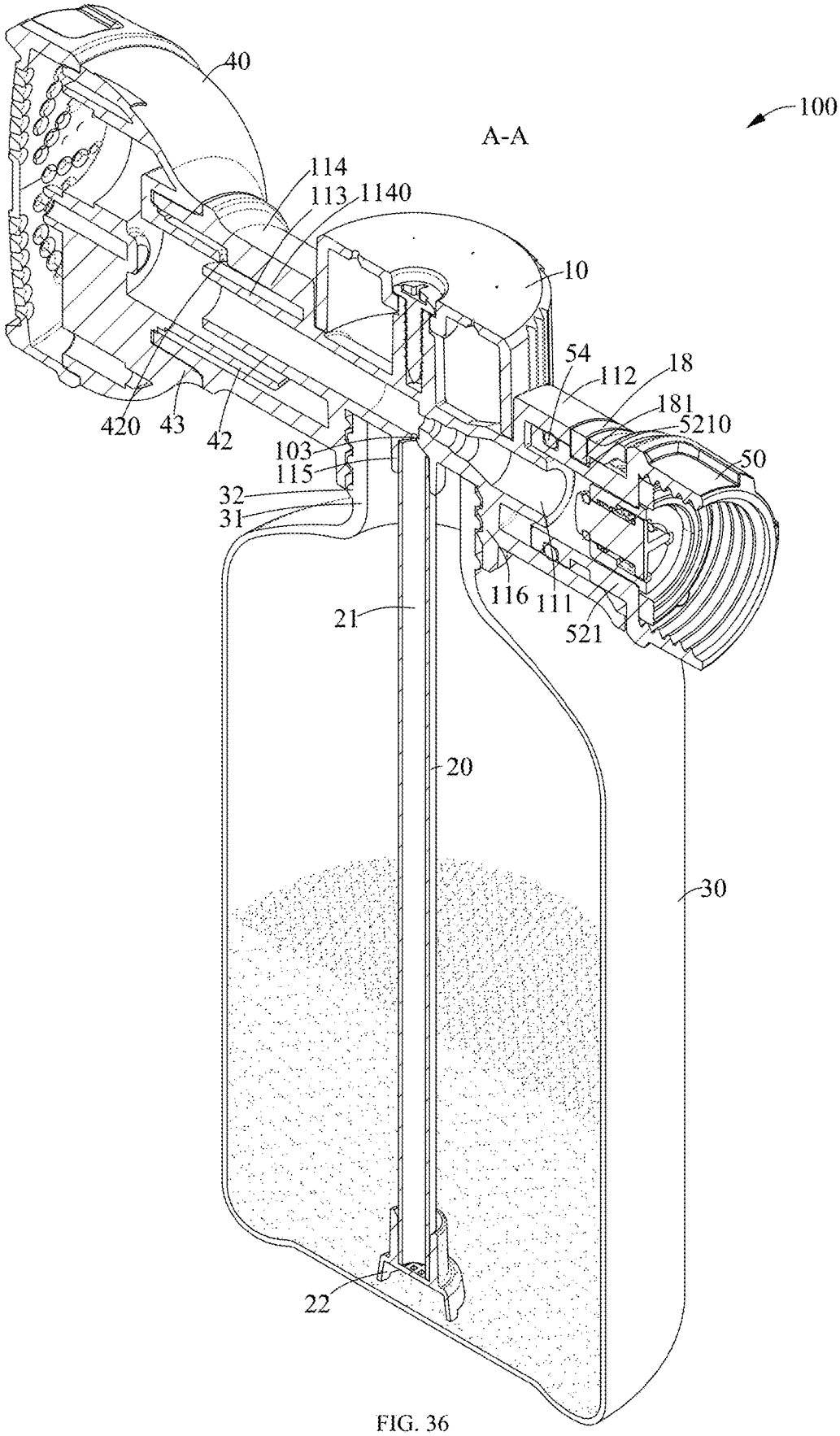
FIG. 36 is a cross-sectional view taken from line A-A in FIG. 2, viewed from another angle.

Referring to FIG. 36, in assembling the spray device 100:

The suction assembly 20 is mounted on the converging assembly 10. The end of the suction pipe 21 away from the filter 22 is sheathed in the third pipe 115, that is, the inlet of the third liquid channel 103, and is in interference fit with the third pipe 115.

The container 30 is mounted on the converging assembly 10. The filter 22 and one end of the suction tube 21 equipped with the filter 22 extend into the container 30 through the neck 31, and is immersed in the solution in the container 30. The neck 31 is received in the threaded part 116, and the threaded part 116 is threadedly engaged with the external screw thread 32 of the container 30.

The outlet pipe assembly 40 is mounted on the converging assembly 10. The second tube 113 is received in the outlet pipe 42. The outlet pipe 42 is received in the second surrounding part 114. The positioning part 1140 is received in the limit groove 420 to fix the outlet pipe assembly 40 and the converging assembly 10 in the circumferential and radial directions of the outlet pipe 42. The second surrounding part 114 is sheathed in the annular body 43 and is in interference fit with the annular body 43, such that the outlet pipe assembly 40 and the converging assembly 10 are fixed in the axial direction. The second tube 113 communicates with the outlet pipe 42.

The inlet pipe assembly 50 is mounted on the converging assembly 10. The first tube 111 is sheathed in the connection section 521. The connection section 521 is sheathed in the first surrounding part 112. The part of the second sealing ring 54 protruding from the connection section 521 abuts against the inner wall of the first surrounding part 112. The clamping member 18 fixes the connection section 521 and the first surrounding part 112 together.

Figure 37:
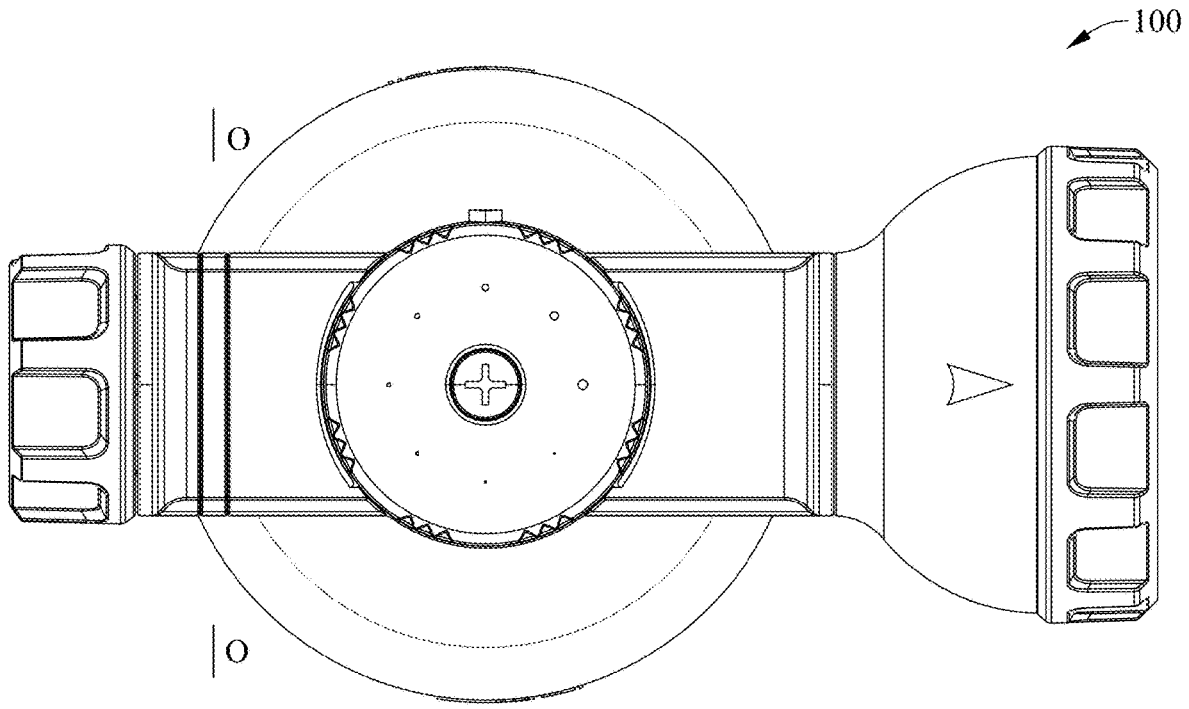
FIG. 37 is a schematic view of the spray device of FIG. 1, viewed from still yet another angle.
Figure 38:
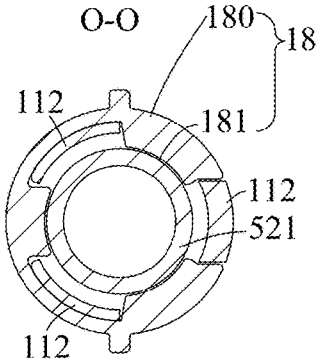
FIG. 38 is a cross-sectional view taken from line 0-0 in FIG. 37.

Referring to FIGS. 36, 37, and 38, the clamping member 18 includes an embracing part 180 and a clamping body 181. The embracing part 180 is a semi-closed ring. The clamping body 181 protrudes from an inner wall of the embracing part 180. The embracing part 180 surrounds the first surrounding part 112. The clamping body 181 passes through the first surrounding part 112 and is embedded in the first annular groove 5210, such that the outlet pipe assembly 40 and the converging assembly 10 are fixed in the circumferential, radial, and axial directions.

Figure 39:
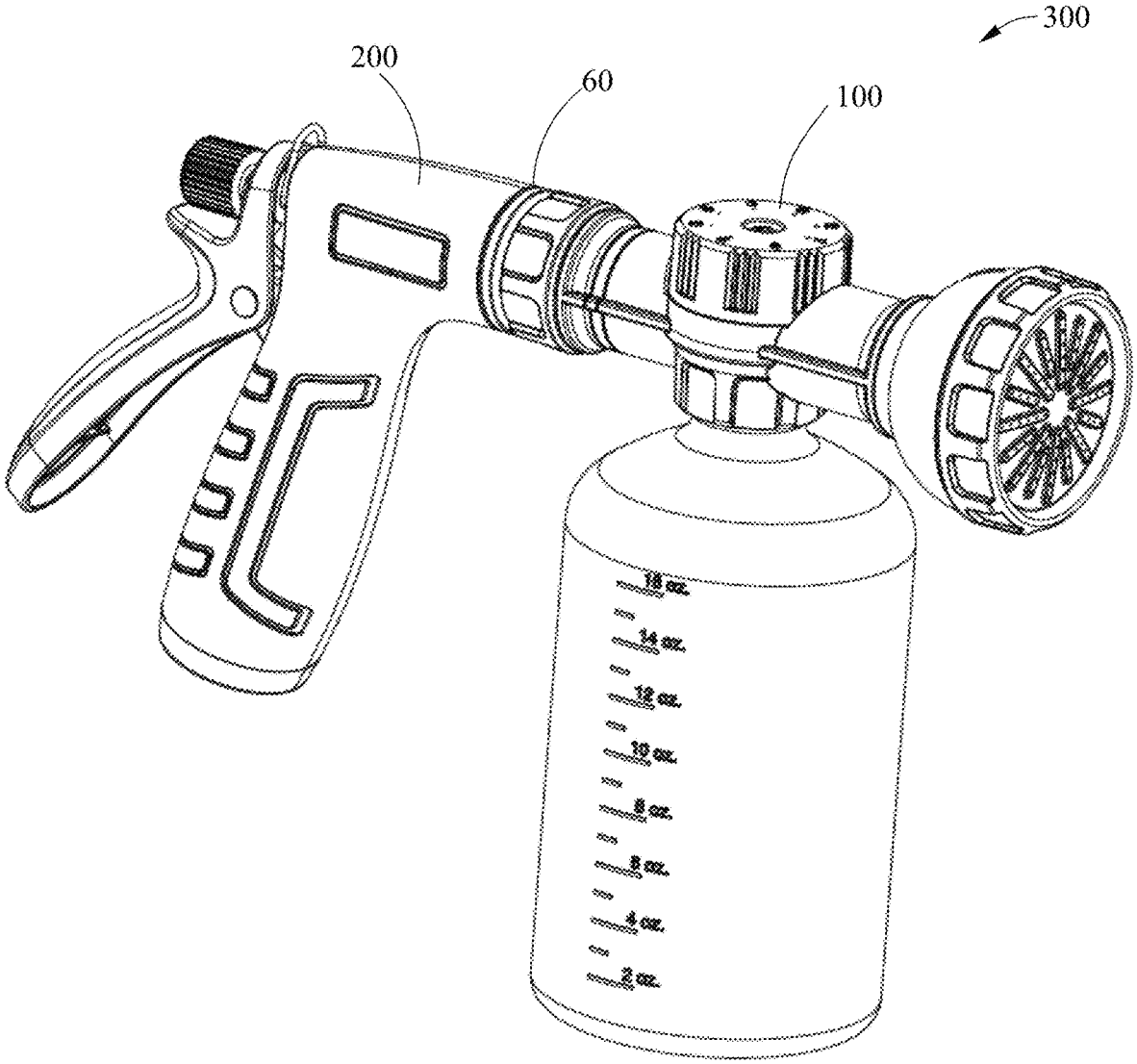
FIG. 39 is a schematic view of a spray system according to an embodiment of the present disclosure.

Referring to FIG. 39, another embodiment of the present disclosure further provides a spray system 300, which includes the aforesaid spray device 100 and a liquid supply device 200.

The liquid supply device 200 is configured to supply liquid to the spray device 100.

The liquid supply device 200 can be a water hose, water gun, or the like.

The liquid supply device 200 includes an external thread pipe 60 in threaded connection to the internal thread section 520. The external thread pipe 60 abuts against the gasket 53 thus being separated from the bushing 511.

The exemplary embodiments described above does not constitute a limitation on the protection scope of the technical solution. Any modification, equivalent replacement and improvement made within the spirit and principle of the above exemplary embodiments shall be included in the protection scope of the technical scheme.

Finally, it should be noted that: the above embodiments are only used to illustrate but are not intended to limit the technical solution of the present disclosure; under the concept of the present disclosure, the technical features in the aforesaid embodiments or different embodiments can also be combined, and the steps can be realized in arbitrary order. There are many other changes in different aspects of the present disclosure as described above, but, for the sake of simplicity, they are not detailed in the present disclosure. It should be understood by those skilled in the art that the technical solutions described in the above-mentioned embodiments can be modified, or some of the technical features can be replaced equivalently; and these modifications or substitutions do not make the corresponding technical solutions deviate from the essence of the technical solutions of the present disclosure.

What is claimed is:

1. A spray device, comprising:

a converging assembly, the converging assembly comprising a first liquid channel, a second liquid channel, a first air channel, and a second air channel; an outlet of the first liquid channel communicating with an inlet of the second liquid channel, and the first air channel communicating with the inlet of the second liquid channel;

a container configured to accommodate a solution, and the second air channel communicating with the container; and a suction pipe, the suction pipe comprising a first end communicating with the inlet of the second liquid channel, and a second end configured to be submerged in the solution in the container;

wherein, the converging assembly comprises a converging part and a rotating member;

the first liquid channel and the second liquid channel are both defined in the converging part; the converging part comprises an air passage; the air passage communicates with the inlet of the second liquid channel;

the rotating member comprises a central axis, a first air vent, a second air vent and a third air vent;

the first air vent, the second air vent and the third air vent deviates from the central axis; the first air vent, the second air vent and the third air vent are positioned around the central axis and are spaced apart from each other, diameters of the first air vent and the second air vent are different from each other;

the rotating member is positioned on the converging part and is rotatable around the central axis with respect to the converging part, such that the rotating member blocks the air passage, or the first air vent communicates with the air passage to form the first air channel;

the rotating member is capable of being rotated to enable one of the first air vent and the second air vent to communicate with an outlet of the air passage;

the rotating member and the converging part cooperative define an air chamber;

the converging part comprises a communication hole, and the air chamber communicates with the container via the communication hole, when the second end is submerged in the solution in the container, the rotating member rotates and the first air vent communicates with the air passage, the third air vent communicates with the air chamber, and the third air vent, the air chamber, and the communication hole cooperatively form the second air channel configured to balance an air pressure in the container;

when a liquid flows from the first liquid channel to the inlet of the second liquid channel, at least part of air in the first liquid channel is discharged via the first air channel, whereby a negative pressure is formed in the second liquid channel, such that the solution is sucked to the second liquid channel through the suction pipe, an external air enters the container via the second air channel to balance the air pressure in the container, the solution and the liquid are mixed at the inlet of the second liquid channel, and then the mixture of the liquid and the solution are sprayed from an outlet of the second liquid channel.

2. The spray device of claim 1, wherein the converging assembly further comprises a sliding member and a first elastic member;

the sliding member and the first elastic member are both positioned on the converging part; and when the rotating member rotates and the first air vent communicates with the outlet of the air passage, the first elastic member drives the sliding member to move and be caught in the second air vent, so as to prevent the rotation of the rotating member.

3. The spray device of claim 1, wherein the rotating member comprises a base wall and an enclosing wall surrounding the base wall;

the first air vent, the second air vent, and the third air vent all pass through the base wall; and the converging part comprises a main body and a support column, the support column is positioned on the main body, a center line of the support column coincides with the central axis, and the support column is sheathed in the base wall such that the rotating member is rotatably positioned on the converging part.

4. The spray device of claim 3, wherein the converging part comprises a mounting cavity, one end of the mounting cavity is connected to the main body, and the other end of the mounting cavity is attached to the base wall; and the sliding member and the first elastic member are both received in the mounting cavity, and the first elastic member is positioned between the sliding member and an inner sidewall of the mounting cavity.

5. The spray device of claim 4, wherein the converging part comprises an air tube, one end of the air tube is connected to the main body, and the other end of the air tube is attached to the base wall;

the air passage passes through the air tube and extends into the main body, an inlet of the air passage is positioned on the main body, and the outlet of the air passage is positioned on the air tube; and the support column is located between the mounting cavity and the air tube.

6. The spray device of claim 5, wherein an included angle between an orientation of the inlet of the air passage and an orientation of the outlet of the air passage is 90 degrees.

7. The spray device of claim 5, wherein the converging assembly comprises a first sealing ring, the first sealing ring is positioned at the outlet of the air passage, the first sealing ring partially protrudes from an end of the air tube close to the base wall and abuts against the base wall, and the first sealing ring seals a joint of the air passage and one of the first air vent, the second air vent, and the third air vent.

8. The spray device of claim 1, wherein the spray device further comprises an inlet pipe assembly;

the inlet pipe assembly comprises a liquid inlet pipe and a check valve;

the liquid inlet pipe communicates with an inlet of the first liquid channel; the liquid inlet pipe is configured to receive the liquid, and supplies the liquid to the inlet of the first liquid channel; and the check valve is positioned on the liquid inlet pipe, and is configured to open the liquid inlet pipe spontaneously when the liquid inlet pipe receives the liquid, and close the liquid inlet pipe spontaneously when the liquid inlet pipe stops receiving the liquid.

9. The spray device of claim 8, wherein the check valve comprises a piston, a bushing, and a second elastic member;

the bushing is sheathed in the liquid inlet pipe;

the piston is sheathed in the bushing;

when the liquid inlet pipe receives the liquid, the liquid pushes the piston to move to open the bushing; and when the liquid inlet pipe stops receiving the liquid, the second elastic member drives the piston to move to close the bushing.

10. The spray device of claim 9, wherein the check valve further comprises a second sealing ring;

the piston comprises a plurality of fork parts, a stop part, and a guide part; the fork parts converges at a convergence point; one end of each fork part is connected to the stop part, and the other end of each fork part protrudes away from the convergence point to form the guide part;

the bushing comprises a body and an inner ring part; the body comprises a first end and a second end opposite to the first end; the inner ring part protrudes from an inner wall on the second end of the body; a plurality of guide grooves is defined on an inner wall on the first end of the body; one end of each guide groove is close to the inner ring part, and the other end of each guide groove is away from the inner ring part;

the fork parts are positioned in the body; guide parts of the fork parts are positioned in the guide grooves, respectively; the second elastic member surrounds the fork parts and is received in the body; one end of the second elastic member abuts against the inner ring part, and the other end of the second elastic member abuts against the guide parts; the stop part extends out of the body; the second sealing ring is positioned around a position between two ends of the stop part;

when the piston opens the bushing, the guide parts abut against ends of the guide grooves close to the inner ring part to prevent the piston from further moving; the second elastic member is compressed, and the inner ring part surrounds the fork parts, to form a gap allowing the liquid to pass through; and when the piston closes the bushing, the guide parts move to the ends of the guide grooves away from the inner ring part, and the second elastic member recovers; one end of the stop part connecting to the fork parts closes the inner ring part, and the second sealing ring abuts against the inner ring part to prevent the piston from further moving.

11. The spray device of claim 1, further comprising an inlet pipe assembly and an outlet pipe assembly;

wherein the inlet pipe assembly and the outlet pipe assembly are positioned at two opposite ends of the converging assembly, respectively; the inlet pipe assembly communicates with the inlet of the first liquid channel, and the outlet pipe assembly communicates with the outlet of the second liquid channel;

the container is positioned on a bottom end of the converging assembly; and a weight ratio of the inlet pipe assembly and the outlet pipe assembly is a preset value, such that a gravity center of the spray device is located on the converging assembly.

12. The spray device of claim 11, wherein the converging assembly comprises a main body, a first tube, and a first surrounding part;

the first tube protrudes from a first end of the main body, the first liquid channel passes through the first tube and extends into the main body, the inlet of the first liquid channel is positioned in the first tube, and an outlet of the first liquid channel is positioned in the main body;

the first surrounding part protrudes from the first end of the main body, and the first surrounding part surrounds the first tube and is spaced apart from the first tube;

the inlet pipe assembly comprises a check valve and a liquid inlet pipe, the check valve is received in the liquid inlet pipe, and the check valve is configured to open the liquid inlet pipe spontaneously when the liquid inlet pipe receives liquid and close the liquid inlet pipe spontaneously when the liquid inlet pipe stops receiving the liquid; and the liquid inlet pipe comprises a connection section, the first tube is sheathed in the connection section, and the connection section is sheathed in the first surrounding part.

13. The spray device of claim 12, wherein an outer wall of the connection section defines an annular groove, and the annular groove is extending along a circumferential direction of the outer wall; and the converging assembly comprises a clamping member, the clamping member comprises an embracing part and a clamping body, the clamping body protrudes from an inner wall of the embracing part, the embracing part surrounds the first surrounding part, and the clamping body passes through the first surrounding part and is embedded in the annular groove.

14. The spray device of claim 12, wherein the converging assembly comprises a second tube and a second surrounding part;

the second tube protrudes from a second end of the main body, and the second tube and the first tube are positioned on two opposite ends of the main body;

the second liquid channel passes through the second tube and extends into the main body, the inlet of the second liquid channel is positioned in the main body, and the outlet of the second liquid channel is positioned in the second tube;

the second surrounding part protrudes from the second end of the main body, and the second surrounding part surrounds the second tube and is spaced apart from the second tube;

the outlet pipe assembly comprises a liquid chamber, an outlet pipe, and an annular body surrounding the outlet pipe;

the liquid chamber defines a plurality of sieve pores, the outlet pipe protrudes out of the liquid chamber and communicates with the liquid chamber, and an end of the annular body is connected to the liquid chamber; and the second tube is received in the outlet pipe, the second tube communicates with the outlet pipe, the outlet pipe is received in the second surrounding part, and the second surrounding part is sheathed in the annular body and is in interference fit with the annular body.

15. The spray device of claim 14, wherein an inner wall of the second surrounding part protrudes to form a positioning part, and the positioning part extends along an axial direction of the second surrounding part;

an end of the outlet pipe away from the liquid chamber defines a limit groove; and the positioning part is received in the limit groove to secure the outlet pipe assembly to the converging assembly in a circumferential direction and a radial direction of the outlet pipe.

16. The spray device of claim 12, wherein the converging assembly comprises a third tube and a threaded part, the third tube protrudes from a bottom end of the main body, the threaded part protrudes from the bottom end of the main body, and the threaded part surrounds the third tube and is spaced apart from the third tube;

the third liquid channel passes through the third tube and extends into the main body, an inlet of the third liquid channel is positioned in the third tube, and an outlet of the third liquid channel is positioned in the main body;

the container comprises a neck, an outer wall of the neck comprises external screw thread, the neck is received in the threaded part, and the threaded part is threadedly engaged with the external screw thread; and an end of the suction pipe is sheathed in the third pipe and is in interference fit with the third pipe.

17. A spray system, comprising:

the spray device of claim 1; and a liquid supply device connected to the spray device and configured to supply the liquid to the spray device.

* * * * *